United States Patent [19]

Mitarai

[11] 4,453,440

[45] Jun. 12, 1984

[54] ENVELOPE CONTROL SYSTEM FOR ELECTRONIC MUSICAL INSTRUMENT

[75] Inventor: Tsuyoshi Mitarai, Yokohama, Japan

[73] Assignee: Casio Computer Co., Ltd., Tokyo, Japan

[21] Appl. No.: 324,466

[22] Filed: Nov. 24, 1981

[30] Foreign Application Priority Data

| | | | |
|---|---|---|---|
| Nov. 28, 1980 | [JP] | Japan | 55-167582 |
| Nov. 28, 1980 | [JP] | Japan | 55-167583 |
| Mar. 16, 1981 | [JP] | Japan | 56-36595 |
| Aug. 21, 1981 | [JP] | Japan | 56-130875 |

[51] Int. Cl.[3] ..... G10H 1/06

[52] U.S. Cl. ..... 84/1.22; 84/1.26

[58] Field of Search ..... 84/1.01, 1.19, 1.22, 84/1.26, 1.13

[56] References Cited

U.S. PATENT DOCUMENTS

| | | | |
|---|---|---|---|
| 3,740,450 | 6/1973 | Deutsch | 84/1.24 |
| 4,079,650 | 3/1978 | Deutsch et al. | 84/1.26 |
| 4,085,644 | 4/1978 | Deutsch et al. | 84/1.01 |
| 4,227,435 | 10/1980 | Ando et al. | 84/1.19 |
| 4,281,574 | 8/1981 | Deutsch | 84/1.22 |
| 4,296,663 | 10/1981 | Chibana | 84/1.26 |

FOREIGN PATENT DOCUMENTS

| | | |
|---|---|---|
| 2709560 | 7/1977 | Fed. Rep. of Germany . |
| 2926090 | 3/1979 | Fed. Rep. of Germany . |
| 53-102020 | 9/1978 | Japan . |

*Primary Examiner*—Forester W. Isen

*Attorney, Agent, or Firm*—Frishauf, Holtz, Goodman & Woodward

[57] ABSTRACT

Frequency data read out from a frequency data conversion ROM in response to a key code generated at a keyboard according to a depressed note key is accumulated at an accumulator and the accumulated result is supplied to an A input terminals of an adder. On the other hand, envelope data generated by an envelope data generating circuit is supplied to a B input terminal of the adder through exclusive OR gates under the control of a clock Ø. The frequency data and envelope data are summed at the adder and the resultant of addition is supplied as an addressing signal to a sine wave ROM for reading out therefrom an envelope-controlled musical sound signal.

16 Claims, 33 Drawing Figures

FIG. 15

| TIMING | CLOCK | S6 | S5 | S4 | S3 | Z11 | Z10 | Z9 | Z8 | Z7 | Z6 | Z5 | Z4 | Z3 | Z2 | Z1 | Z0 | |
|---|---|---|---|---|---|---|---|---|---|---|---|---|---|---|---|---|---|---|
| t0–t1 | CKA0 | 0 | 0 | 0 | | 0 | 0 | 0 | 0 | 0 | 0 | 0 | 0 | S3 | S2 | S1 | S0 | ATTACK |
| t1–t2 | CKA1 | 0 | 0 | 1 | | 0 | 0 | 0 | 0 | 0 | 0 | 0 | 1 | S3 | S2 | S1 | S0 | |
| t2–t3 | CKA2 | 0 | 1 | 0 | | 0 | 0 | 0 | 0 | 0 | 0 | 1 | S3 | S2 | S1 | S0 | 0 | |
| t3–t4 | CKA3 | 0 | 1 | 1 | | 0 | 0 | 0 | 0 | 0 | 1 | S3 | S2 | S1 | S0 | 0 | 0 | |
| t4–t5 | CKA4 | 1 | 0 | 0 | | 0 | 0 | 0 | 0 | 1 | S3 | S2 | S1 | S0 | 0 | 0 | 0 | |
| t5–t6 | CKA5 | 1 | 0 | 1 | | 0 | 0 | 0 | 1 | S3 | S2 | S1 | S0 | 0 | 0 | 0 | 0 | |
| t6–t7 | CKA6 | 1 | 1 | 0 | | 0 | 0 | 1 | S3 | S2 | S1 | S0 | 0 | 0 | 0 | 0 | 0 | |
| t7–t8 | CKA7 | 1 | 1 | 1 | 0 | 0 | 1 | S2 | S1 | S0 | 0 | 0 | 0 | 0 | 0 | 0 | 0 | |
| t8 | CKA7 | 1 | 1 | 1 | 1 | 1 | 0 | 0 | 0 | 0 | 0 | 0 | 0 | 0 | 0 | 0 | 0 | ATTACK END |
| t8–t9 | CKD | 1 | 1 | 1 | | 0 | 1 | S2 | S1 | S0 | 0 | 0 | 0 | 0 | 0 | 0 | 0 | DECAY |
| t9–t10 | CKD | 1 | 1 | 0 | | 0 | 0 | 1 | S3 | S2 | S1 | S0 | 0 | 0 | 0 | 0 | 0 | |
| t10–t11 | CKD | 1 | 1 | 0 | | 0 | 0 | 1 | 0 | 0 | 0 | 0 | 0 | 0 | 0 | 0 | 0 | SUSTAIN |
| t11–t12 | CKD | 1 | 0 | 1 | | 0 | 0 | 0 | 1 | S3 | S2 | S1 | S0 | 0 | 0 | 0 | 0 | RELEASE |
| t12–t13 | CKD | 1 | 0 | 0 | | 0 | 0 | 0 | 0 | 1 | S3 | S2 | S1 | S0 | 0 | 0 | 0 | |
| t13–t14 | CKD | 0 | 1 | 1 | | 0 | 0 | 0 | 0 | 0 | 1 | S3 | S2 | S1 | S0 | 0 | 0 | |
| t14–t15 | CKD | 0 | 1 | 0 | | 0 | 0 | 0 | 0 | 0 | 0 | 1 | S3 | S2 | S1 | S0 | 0 | |
| t15–t16 | CKD | 0 | 0 | 1 | | 0 | 0 | 0 | 0 | 0 | 0 | 0 | 1 | S3 | S2 | S1 | S0 | |
| t16–t17 | CKD | 0 | 0 | 0 | | 0 | 0 | 0 | 0 | 0 | 0 | 0 | 0 | S3 | S2 | S1 | S0 | |

(1) S 0
32
64(=0)
(2) S 32
64(=0)
32
(3)

(1) S 0
32
64(=0)
(2) S 16
48
16
(3)

(1) S 0
32
64(=0)
(2) S 0
32
64(=0)
(3)

ENVELOPE CONTROL SYSTEM FOR ELECTRONIC MUSICAL INSTRUMENT

BACKGROUND OF THE INVENTION

This invention relates to envelope control systems for electronic musical instruments in which digital data representing musical sound waveforms is read out from a memory for producing musical sounds with the envelope thereof controlled.

Recently, in the field of electronic musical instruments, the main circuit of the instrument is constructed by using digital techniques. In this technology, digital data representing musical sound waveforms are stored in a waveform memory and are read out under the control of read-out clocks corresponding to note frequencies or with a read-out clock of a fixed frequency for all the notes but with different phase angles according to the note frequencies, thereby producing musical sounds having predetermined waveforms.

In the waveform memory, sampled data of a waveform of a predetermined natural musical instrument for one period is stored. Alternately, data of a waveform of a predetermined function, for instance a sinusoidal waveform data, is stored. When reproducing musical sound by reading out the waveform data stored in the waveform memory, envelope control of the musical sound is also done. To this end, it is necessary to multiply the digital waveform data and digital data representing the envelope by using a multipler.

To correctly calculate the amplitude value of the envelope controlled musical sound waveform by using the multipler, it is necessary to make calculations on all the bits constituting the waveform data and envelope data and derive the result of multiplication, for instance down to data of lower significant bits than the same number of bits as the bit number of both the waveform and envelope data. Therefore, the multiplier of whatever calculation system used to this end, renders the overall circuit construction more complex with increasing bit number and constitutes an obstacle when it is intended to integrate the circuit of an electronic musical instrument.

SUMMARY OF THE INVENTION

An object of the invention is to provide an envelope control system for an electronic musical instrument, with which an envelope controlled musical sound signal can be formed from the digital waveform data and digital envelope data without need of a complicated circuit and which is thus suited to the integration of an electronic musical instrument circuit.

The envelope control system according to the invention, which is used for an electronic musical instrument for forming a musical sound signal by reading out a periodic function data such as a sinusoidal or cosinusoidal waveform data from a waveform memory according to the note frequency, comprises means for reading out two periodic function waveform data at the same frequency but having different phases from at least one waveform memory, means for changing the phase of at least one of the two waveform data according to a given envelope, and means for combining the two read-out waveform data to obtain an envelope controlled composite waveform data.

BRIEF DESCRIPTION OF THE DRAWINGS

FIG. 15 is a table listing the envelope correction operation of the circuit of FIGS. 11A and 11B for individual timings;

DETAILED DESCRIPTION OF THE PREFERRED EMBODIMENTS

Figure 1:
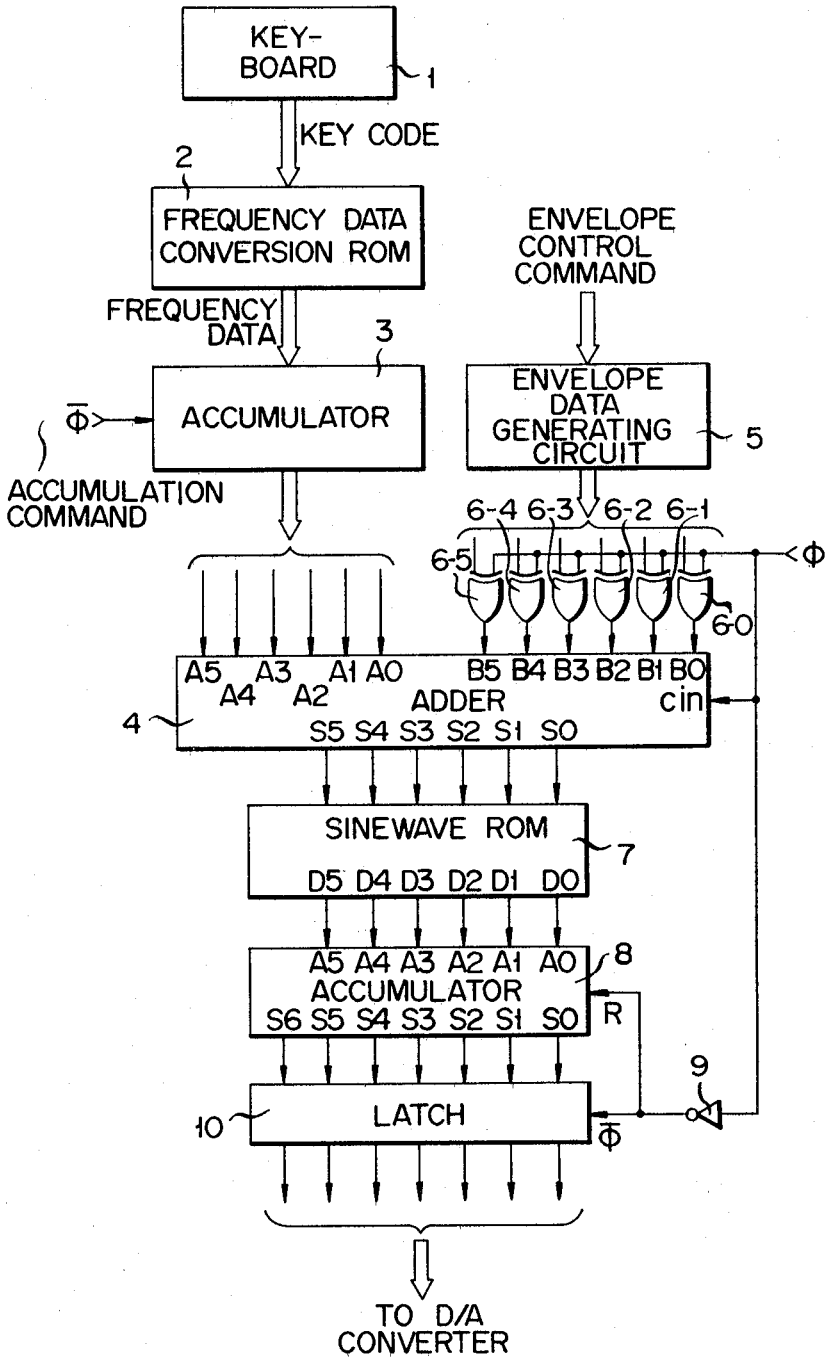
FIG. 1 is a block diagram showing one embodiment of the envelope control system according to the invention.

Referring now to FIG. 1, a keyboard 1, which has a plurality of note keys of a keyboard electronic musical instrument, generates a key code data corresponding to each operated note key. Where the keyboard has note keys for five octaves, for instance, the key code data contains information about the octave, i.e., one of the first to fifth octaves, to which the operated note key belongs, and also information about the note, i.e., one of the notes Do, Re, Mi, Fa, So, La, Ti, Do, to which the operated note key corresponds.

This key code data is fed as an address signal to a frequency data conversion ROM 2. In the ROM 2 frequency data of individual key codes are stored, and the frequency data read out according to the input key code data is fed to an accumulator 3. To the accumulator 3 a clock signal $\phi$ is supplied as an accumulation command, and every time this command is given, the accumulator 3 accumulates the frequency data from the ROM 2. The clock signal $\phi$ is given at a fixed interval, and if the frequency data from the ROM 2 represents a low frequency, accumulated data obtained in the accumulator 3 also represents a low frequency. Conversely, if the frequency data from the ROM 2 represents a high frequency, the accumulation output data of the accumulator 3 also represents a high frequency.

As the accumulation output data from the accumulator 3, 6-bit data, for instance, is fed to A input terminals A0 to A5 of an adder 4. The adder 4 also has B input terminals B0 to B5, to which 6-bit data from an envelope data generating circuit 5 is supplied through exclusive OR gates 6-0 to 6-5 which are gate controlled by the clock signal $\phi$. The adder 4 further has a carry input terminal Cin, to which the clock signal $\phi$ is supplied.

To the envelope data generating circuit 5 is supplied an envelope control command, which is ADSR (attack, decay, sustain and release) data preset by on-off data of an operated note key on the keyboard 1 or by a switch. In this cirucit, 6-bit envelope data for the envelope control is formed according to the input data.

When the clock $\phi$ supplied to one input terminal of each of the exclusive OR gates 6-0 to 6-5 is at "0" level, the 6-bit data from the circuit 5 is coupled through the exclusive OR gates 6-0 to 6-5 to the B input terminals B0 to B5 of the adder 4. At this time, the adder 4 adds the two 6-bit data directed to the A and B input terminals A0 to A5 and B0 to B5, and provides the resultant sum data as 6-bit data from its S output terminals S0 to S5. When the clock signal is at "1" level, the 6-bit data from the circuit 5 is inverted by the exclusive OR gates 6-0 to 6-5 before it is supplied to the B input terminals B0 to B5. At this time, a "1" signal is supplied to the carry input terminal Cin, so that data as a result of incrementation of the aforementioned inverted 6-bit data by "+1" is supplied to the B input terminals B0 to B5. In other words, data as a result of the inversion of the sign of the 6-bit data from the circuit 5 (2's complement) and the 6-bit data supplied to the A input terminals A0 to A5 are added together to provide the result from the S output terminals S0 to S5.

Figure 2:
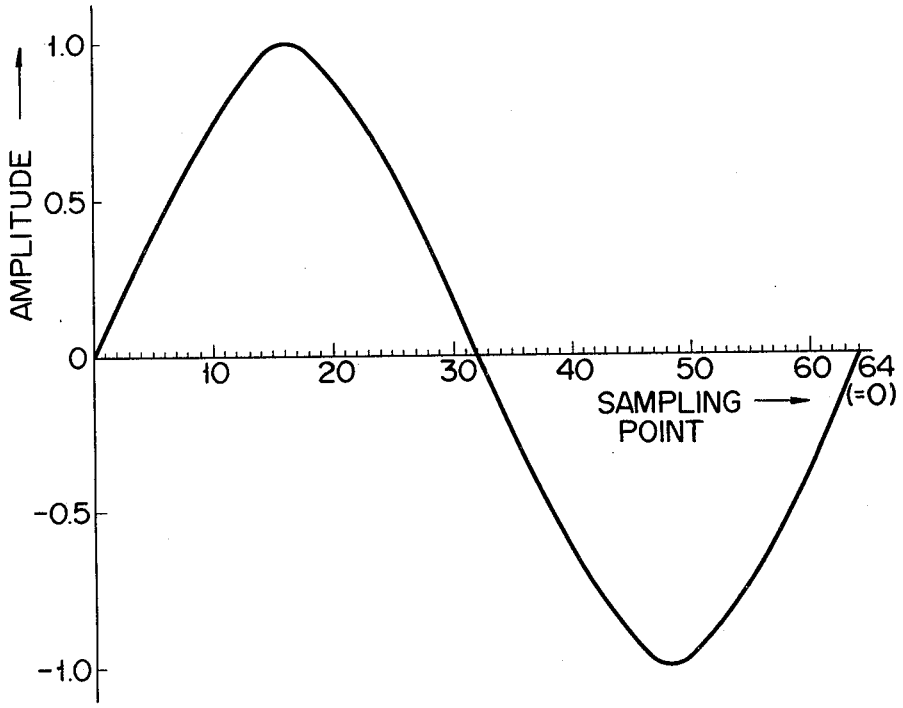
FIG. 2 is a view showing a sine waveform stored in a sine wave ROM shown in FIG. 1.

The 6-bit data provided from the adder 4 is fed to a sine wave ROM 7 for address designation thereof. In the sine wave ROM 7, amplitude values of a sine wave for $2^6$ (=64) sampling points as shown in FIG. 2 are stored. The sine wave ROM 7 provides 6-bit data D0 to D5 as amplitude value data. Of these output data, the most significant bit D5 is a sign bit, and the second to the least significant bits D4 to D5 are bits which represent a decimal fraction data.

This data is fed to A input terminals A0 to A5 of an accumulator 8 and accumulated. The accumulator 8 is reset when it receives at its reset terminal R with the rising of a signal from an inverter 9 inverting the aforementioned clock $\phi$, i.e., the clock $\phi$. The accumulator 8 provides 7-bit data from its S output terminals S0 to S6. Of these output data, the most significant bit S6 is a sign bit, the second significant bit S5 is a bit for the $2^0$ place, and the third to the least significant bits S4 to S0 are bits representing the decimal fraction data.

The 7-bit data provided from the accumulator 8 is read into a latch 10 with the rising of the clock $\phi$. The output data from the latch is fed to a D/A converter (not shown) for conversion to analog signal, which is coupled to a sound producing circuit such as a loudspeaker for producing sound.

The operation of this embodiment will now be described. In the first place, the clock $\phi$ and the inverted clock $\phi$ (i.e., accumulation command $\phi$) as mentioned above in connection with FIG. 3 will be discussed. These clocks $\phi$ and $\phi$ assume alternate "0" and "1" levels oppositely as shown in (*a*) and (*b*) in FIG. 3. For the sake of the simplicity, the period corresponding to the "0" level of the clock $\phi$ is referred to as timing T0, and the period corresponding to the "1" of the clock $\phi$ as timing T1.

Figure 3:
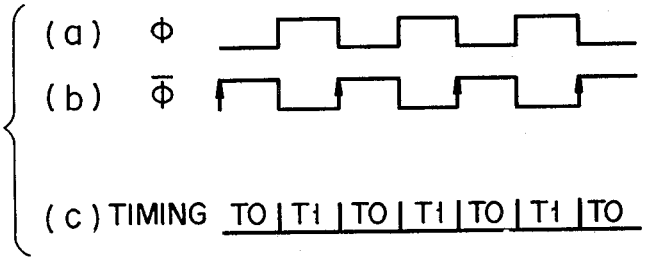
FIG. 3 is a view illustrating clock pulses for driving the circuit of FIG. 1 and also the time division basis operation of the circuit.

The circuit of FIG. 1 operates on a time division basis with two distinct timings as shown in (*c*) in FIG. 3. More particularly, every time the accumulation command $\phi$ becomes "1" in the timing T0, the accumulator 3 receives frequency data corresponding to an operated note key from the ROM 2 and accumulates it to couple the resultant accumulated data to the adder 4.

In this timing T0, the data from the envelope data generating circuit 5 is directly fed to the B input terminals of the adder 4, and thus this data and the data fed to the A input terminals are added together. In the timing T1, data as a result of the inversion of the signal of the data from the envelope data generating circuit 5 as mentioned earlier, is fed to the B input terminals, and thus this data and the data fed to the A input terminals are added together in the adder 4. The sum data thus obtained is fed to the sine wave ROM 7.

The sine wave ROM 7 is thus address-designated in the two distinct timings, i.e., timings T0 and T1, and data read out from the sine wave ROM 7 in each of these timings is accumulated in the accumulator 8. Since the accumulator 8 is reset with every rising of the clock $\phi$, it effects accumulation only during a pair of timings T0 and T1. The result of accumulation is latched into the latch 10 at the timing of the rising of the clock $\phi$.

The operation described above will now be discussed mathematically. The amplitude value read out from the sine wave ROM 7 in the timing T0 is given as $$\sin 2\pi \frac{a+b}{2^6} = \sin \frac{(a+b)\pi}{32} \quad (1)$$

where "a" is the data supplied to the A input terminals of the adder 4 and "b" is the data coupled from the envelope data generating circuit 5 to the exclusive OR gates 6-0 to 6-5.

The amplitude data read out from the since wave ROM 7 in the timing T1 is $$\sin 2\pi \frac{a-b}{2^6} = \sin \frac{(a-b)\pi}{32} \quad (2)$$

Hence, the output of the accumulator 8 is $$\sin 2\pi \frac{a+b}{2^6} + \sin 2\pi \frac{a-b}{2^6} = 2\sin \frac{\pi}{32} a \cdot \cos \frac{\pi}{32} b \quad (3)$$

It will be seen that the envelope control can be obtained according to the data supplied to the B input terminals of the adder 4. Then envelope control value in this case is $$2\cos \frac{\pi}{32} b \quad (4)$$

Figure 4B:
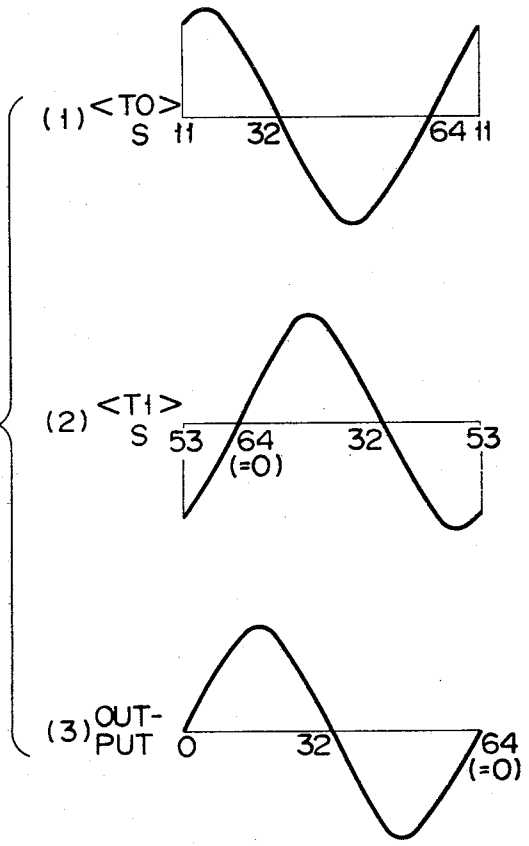
FIGS. 4A to 4C are graphs showing two waveforms read out on a time division basis from a waveform memory and an envelope controlled output waveform obtained from the resultant waveform of the two waveforms.

Now, the envelope control will be discussed in detail with reference to FIGS. 4A to 4C. When there is no waveform provided at a key-on instant, the envelope data generating circuit 5 provides data "16". Consequently, in each timing T0 data obtained as a result of incrementation of the data supplied to the A input terminals of the adder by "+16", i.e., output data "16" if the data supplied to the A input terminals is "0", is supplied to the sine wave ROM 7 for address designation. On the other hand, in each timing T1 data obtained as a result of incrementation of the data supplied to the A input terminals by "−16", i.e., output data "64−16=48" if the data supplied to the A input terminals is "0", is supplied to the sine wave ROM 7 for address designation.

Figure 4A:
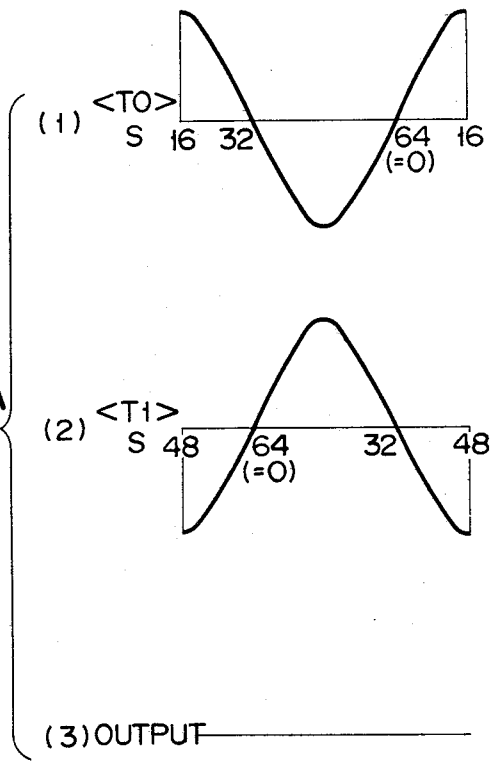

FIG. 4A shows this relation. More particularly, the data provided from the sine wave ROM 7 in the timing T0 is shown in (1), and the data provided from the sine wave ROM 7 in the timing T1 is shown in (2). Since the data shown in (1) and (2) are out of phase from each other by $\pi$, the resultant sum data, i.e., output data from the latch 10 amounts to no waveform at all as shown in (3).

As the data supplied from the envelope data generating circuit 5 to the exclusive OR gates 6-0 to 6-5 is gradually reduced from "16", the amplitude of the output waveform greatly increases. For example, in the state shown in FIG. 4B, in which the data supplied to the exclusive OR gates 6-0 to 6-5 is "11", the data provided from the sine wave ROM 7 in the timings T0 and T1 are respectively as shown in (1) and (2), and the output data from the latch 10 is as shown in (3).

Figure 4C:
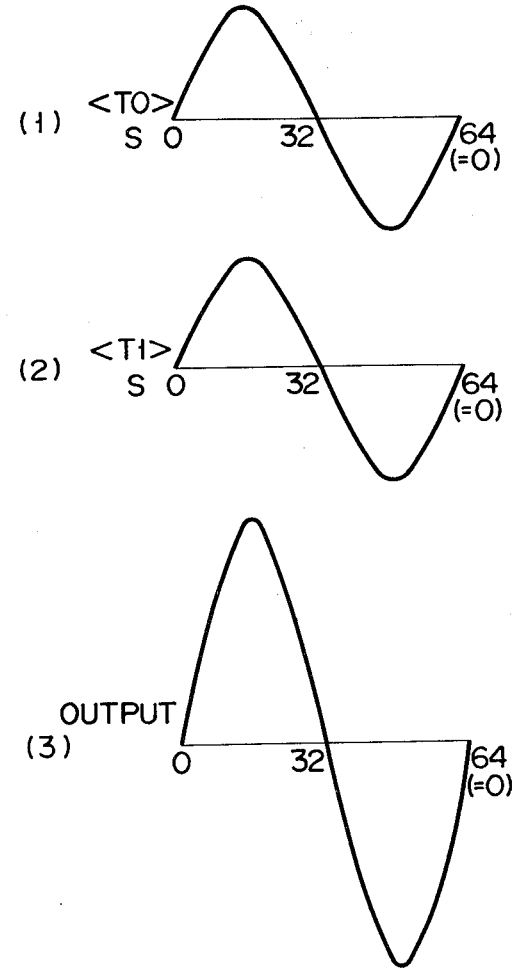

When the data supplied to the B input terminals of the adder is further reduced to "0", a state as shown in FIG. 4C results. In this state, the data read out from the sine wave ROM 7 in the timings T0 and T1 are respectively as shown in (1) and (2), being the same in amplitude. Thus, the output waveform has a maximum amplitude level as shown in (3). More particularly, in the state of FIG. 4C, in which the waveforms shown in (1) and (2) are in phase, the output waveform of FIG. 4C (3) is in phase with but has double the amplitude of the output of (3) in FIG. 4B.

Figure 5:
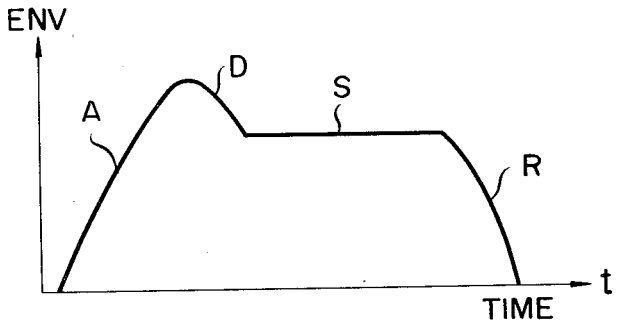
FIG. 5 is a graph showing an envelope waveform obtained by effecting ADSR envelope control on the output waveform provided by the embodiment of FIG. 1.

In order to cause quick rise of the output level from zero level to the maximum level as in the attack portion A of the waveform shown in FIG. 5 when a note key is turned on, the data impressed upon the exclusive OR gates 6-0 to 6-5 may be quickly reduced from "16" to "0". For the decay portion D to be obtained following the attack state, the data impressed upon the exclusive OR gates 6-0 to 6-5 is progressively increased from "0" to a predetermined value. For providing the subsequent sustain state S, the data impressed upon the exclusive OR gate 6-0 to 6-5 is held at the aforementioned predetermined value. By so doing, the amplitude level is held constant as shown in FIG. 5. Then, upon detection of the key-off of the note key, the data impressed upon the exclusive OR gates 6-0 to 6-5 may be gradually increased from the aforementioned predetermined value to "16". This gives the release portion R of the envelope as shown in FIG. 5. When the data impressed upon the exclusive OR gates 6-0 to 6-5 becomes "16", the output level becomes zero, and musical sound is no longer produced.

While the envelope discussed above has included the four envelope states, i.e., the attack, decay, sustain and release states, similar envelope control may also be obtained for an envelope having three envelope states, i.e., attack, sustain and release states, or any other envelopes including different combinations of envelope states.

Further, while in the instant embodiment two waveforms having the same frequency but 180 degrees out of phase with each other are read out from the single sine wave ROM 7 on a time division basis, i.e., in the two distinct timings T0 and T1, it is possible to read out the two waveforms without any time division by using two sine wave ROMs, one of these ROMs being adapted to receive the sum of the data from the accumulator 3 and the output data of the envelope data generating circuit 5 and the other ROM being adapted to receive data as a result of the subtraction of the output data of the envelope data generating circuit 5 from the data of the accumulator 3, and an adder for adding the data provided from both the ROMs.

Further, while in this embodiment the amplitude of a sine wave is stored for $2^6$ (=64) sampling points, where the sine wave amplitude is stored for $2^n$ sampling points, the first and second waveforms read out on the time division basis from the sine wave ROM 7 are given as $$\sin 2\pi \frac{a+b}{2^n} \quad (5)$$

and $$\sin 2\pi \frac{a-b}{2^n} \quad (6)$$

and the resultant waveform is given as $$2\sin \frac{\pi}{2^{n-1}} a \cdot \cos \frac{\pi}{2^{n-1}} b \quad (7)$$

As an alternative, by coupling the output of the accumulator 3 to the A input terminals of the adder 4 through exclusive OR gates, which are similar to the aforementioned exclusive OR gates 6-0 to 6-5 and each receive at one of the input terminals the output of the accumulator 3 and at the other input terminals the clock $\phi$, while directly coupling the output of the envelope data generating circuit 5 to the B input terminals of the adder 4, the first and second waveform mentioned above are given as $$\sin 2\pi \frac{a+b}{2^n} \quad (8)$$

and

-continued $$\sin 2\pi \frac{b-a}{2^n} \tag{9}$$

and the resultant waveform is given as $$2\cos\frac{\pi}{2^{n-1}}a \cdot \sin\frac{\pi}{2^{n-1}}b \tag{10}$$

In this case, the envelope control value is thus $$2\sin\frac{\pi}{2^{n-1}}b \tag{11}$$

Further, while in this embodiment the resultant waveform is obtained by adding together the two sine waves, it is also possible to obtain it by subtracting the two from each other. In this case, the resultant waveform is given as $$\pm\left(\sin 2\pi\frac{a+b}{2^n} - \sin 2\pi\frac{a-b}{2^n}\right) = \pm 2\cos\frac{\pi}{2^{n-1}}a \cdot \sin\frac{\pi}{2^{n-1}}b \tag{12}$$

The envelope control value in this case is $$\pm 2\sin\frac{\pi}{2^{n-1}}b \tag{13}$$

Further, in a subtracting process version of the case of the equations (8) and (9), the resultant waveform is given as $$\pm\left(\sin 2\pi\frac{a+b}{2^n} - \sin 2\pi\frac{b-a}{2^n}\right) = \pm 2\sin\frac{\pi}{2^{n-1}}a \cdot \cos\frac{\pi}{2^{n-1}}b \tag{14}$$

and in this case the envelope control value is $$\pm 2\cos\frac{\pi}{2^{n-1}}b \tag{15}$$

Further it is possible to add or subtract two cosine waves to obtain the resultant waveform. In this case, if the first and second waveforms are given as $$\cos 2\pi\frac{a+b}{2^n} \tag{16}$$

and $$\cos 2\pi\frac{a-b}{2^n} \tag{17}$$

the resultant waveform is given as $$\cos 2\pi\frac{a+b}{2^n} + \cos 2\pi\frac{a-b}{2^n} = 2\cos\frac{\pi}{2^{n-1}}a \cdot \cos\frac{\pi}{2^{n-1}}b \tag{18}$$

or as

-continued $$\pm\left(\cos 2\pi\frac{a+b}{2^n} - \cos 2\pi\frac{a-b}{2^n}\right) = \mp 2\sin\frac{\pi}{2^{n-1}}a \cdot \sin\frac{\pi}{2^{n-1}}b \tag{19}$$

In the case of the equation (18), the envelope control value is $$2\cos\frac{\pi}{2^{n-1}}b \tag{20}$$

and in the case of the equation (19), the envelope control value is $$\mp 2\sin\frac{\pi}{2^{n-1}}b \tag{21}$$

Further, if the first and second waveforms are given as $$\cos 2\pi\frac{a+b}{2^n} \tag{22}$$

and $$\cos 2\pi\frac{b-a}{2^n} \tag{23}$$

the resultant waveform is given as $$\cos 2\pi\frac{a+b}{2^n} + \cos 2\pi\frac{b-1}{2^n} = 2\cos\frac{\pi}{2^{n-1}}a \cdot \cos\frac{\pi}{2^{n-1}}b \tag{24}$$

or as $$\pm\left(\cos 2\pi\frac{a+b}{2^n} - \cos 2\pi\frac{b-a}{2^n}\right) = \mp 2\sin\frac{\pi}{2^{n-1}}a \cdot \sin\frac{\pi}{2^{n-1}}b \tag{25}$$

In the case of the equation (24), the envelope control value is $$2\cos\frac{\pi}{2^{n-1}}b \tag{26}$$

and in the case of the equation (25), the envelope control value is $$\mp 2\sin\frac{\pi}{2^{n-1}}b \tag{27}$$

Further, while in this embodiment the sine wave is stored for one period of the waveform in the sine wave ROM, it is also possible to store a quarter period waveform from 0 to $\pi/2$ and read this data in a manner $0 \rightarrow \pi/2 \rightarrow 0$ as a data of from 0 to $\pi$. Then, the stored waveform data is again read in a similar manner $0 \rightarrow \pi/2 \rightarrow 0$ and the read out data is inverted to produce a data of from $\pi$ to $2\pi$, thereby obtaining data for one period (0 to $2\pi$) of the waveform.

Further, while in this embodiment the sine wave, i.e., the fundamental wave, at the note frequency is obtained in accordance with the operation of the corresponding note key, if it is desired to obtain a higher harmonic sine wave, the output of the frequency data conversion ROM 2 may be subjected to a predetermined bit shift or like process being coupled to the accumulator 3. By so doing, the harmonic sine wave may be obtained as the waveform read out from the sine wave ROM 7. Thus, it is possible to obtain the fundamental wave and harmonic waves of given orders independently in the same manner as described above through a plurality of circuits and combine these waves to obtain the final output. Further, the fundamental wave and harmonic waves may be obtained through a time division basis process with the circuit construction shown in FIG. 1 and also commonly using the sine wave ROM 7, adder 4 and other circuitry, and these waves may be combined to obtain a single musical sound with a complex waveform.

Further, while in this embodiment only a single musical sound is provided for a single operated note key, for permitting the production of a musical sound corresponding to a plurality of simultaneously operated note keys, i.e., a chord, a plurality of circuits having the circuit construction shown in FIG. 1 may be provided so that the operated note keys may be assigned to respective circuits for producing respective musical sounds independently. Further, a plurality of musical sounds may be obtained by driving the circuit having the construction shown in FIG. 1 and using the sine wave ROM 7, adder 4 and other component circuits as common circuitry.

Thus, a plurality of musical sounds at different note frequencies as harmonics of the fundamental wave may be obtained through a time division basis process with the sine wave ROM 7, adder 4 and other component circuits used as common circuitry.

Further, while in this embodiment the address designation of the sine wave ROM 7 is done in successive steps with a phase angle according to the note frequency, a sinusoidal waveform having the same frequency may also be obtained by producing a sampling clock having a frequency of a value equal to the product of the note frequency and number of sampling points, and making access to the sine wave ROM 7 in successive steps under the control of this sampling clock.

Further various changes and modifications of this embodiment are also possible without departing from the scope of the invention.

It is to be appreciated that with this embodiment, applied to an electronic musical instrument in which a sine or cosine wave preliminarily stored in the waveform memory is read out according to the note frequency to produce musical sound, two waveforms at the same frequency and out of phase from each other, are read out and combined to obtain a resultant waveform output while effecting envelope control of the sine or cosine wave according to the extent of the phase difference between the two waveforms, so that no multiplier for effecting the multiplication of the tone value and envelope control value is required at all. Thus, it is possible to reduce hardware, which is very beneficial for the integration of the electronic musical instrument circuit. In addition, the resultant waveform obtained from the two waveforms is in phase with the basic wave and thus has no influence upon the pitch and color of the output musical sound even when it is used for continuous envelope control.

Further, where the two waveforms are obtained by making access to a single waveform memory on a time division basis, the hardware of the waveform memory is only one half compared to the case of providing two waveform memories, thus permitting further reduction of hardware.

The envelope waveform mentioned above and shown in FIG. 5 is obtained as the data b in the equation (11) representing the envelope control value is uniformly increased or reduced. In this envelope waveform, the attack, decay, and release portions A, D and R mentioned above are expressed by the equation (11).

The attenuating portions of the envelope waveform of FIG. 5, i.e., the decay and release portions D and R are both upwardly convex curves. Generally, however, a suitable attenuating sound characteristic is given as a downwardly convex exponential function, and the attenuating envelope portions shown in FIG. 5 are inadequate.

Figure 6:
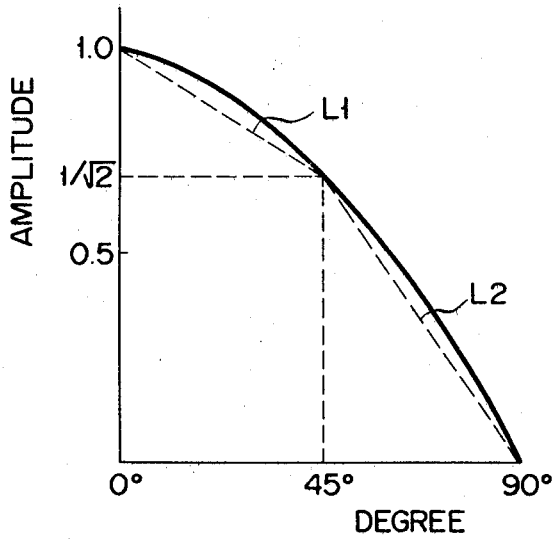
FIG. 6 is a graph showing a method of linear approximation to a quarter period cosine waveform.

In other words, it is necessary, or at least desirous, to convert the sinusoidal envelope waveform portions shown in FIG. 5 into exponential envelope waveforms. To this end, it may be true to assume that a sine wave (or cosine wave) contains two straight line portions L1 and L2 as shown in FIG. 6 and convert these linear changes to exponential changes. The line L1 is a line segment connecting a point corresponding to the maximum amplitude value of 1.0 of the sine wave (i.e., the phase angle of 0 degree) and a point corresponding to an amplitude value of $1\sqrt{2}$ which is leading in phase from the first-mentioned point by 45 degrees. The line L2 is a line segment connecting the aforementioned point with the phase angle of 45 degrees and a point corresponding to a phase angle of 90 degrees (i.e., amplitude value of 0). The line segments L1 and L2 may be converted into exponental curves by, for instance, attenuating the amplitude by ½ for every basic period T of time.

Regarding the method of obtaining an exponential envelope, the applicant has filed a patent application entitled "Apparatus for Generating Attenuated Envelope Waveform". In this case, for the point corresponding to the amplitude of $1/\sqrt{2}$, $x=T/2$ may be substituted into an equation $$y = 2^{-\frac{x}{T}} \tag{28}$$

In other words, for the line segment an attenuation rate corresponding to one half the basic period T may be set, that is, by setting the attenuation rate of the line segment L1 to twice the attenuation rate of the line segment L2, a substantially smooth downwardly convex exponential curve can be obtained to approximate the line segments L1 and L2.

Figure 7:
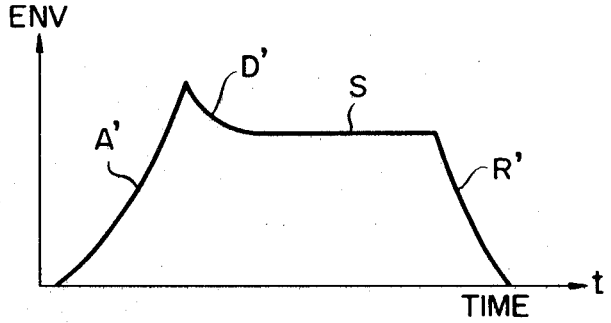
FIG. 7 is a graph showing an envelope waveform obtained by replacing the rising and falling portions of the envelope waveform shown in FIG. 5 with exponential function curves.

If a circuit for modifying the envelope attenuation curve in the manner described above is added, the envelope waveform shown in FIG. 5 may be converted into one as shown in FIG. 7. In the envelope waveform of FIG. 7, the decay and release portions D′ and R′ are certainly satisfactory attenuation curves. However, the attack portion A′ is also converted to a downwardly convex curve by the modifying circuit, which is undesired from the musical standpoint. Accordingly, this attack portion A′ has to be further modified at least to a straight line. This is possible by making the clock frequency variable during the attack portion A′ or, in case when obtaining the attack waveform by adding a value to a counter output for every predetermined timing, making that value variable.

Figure 8:
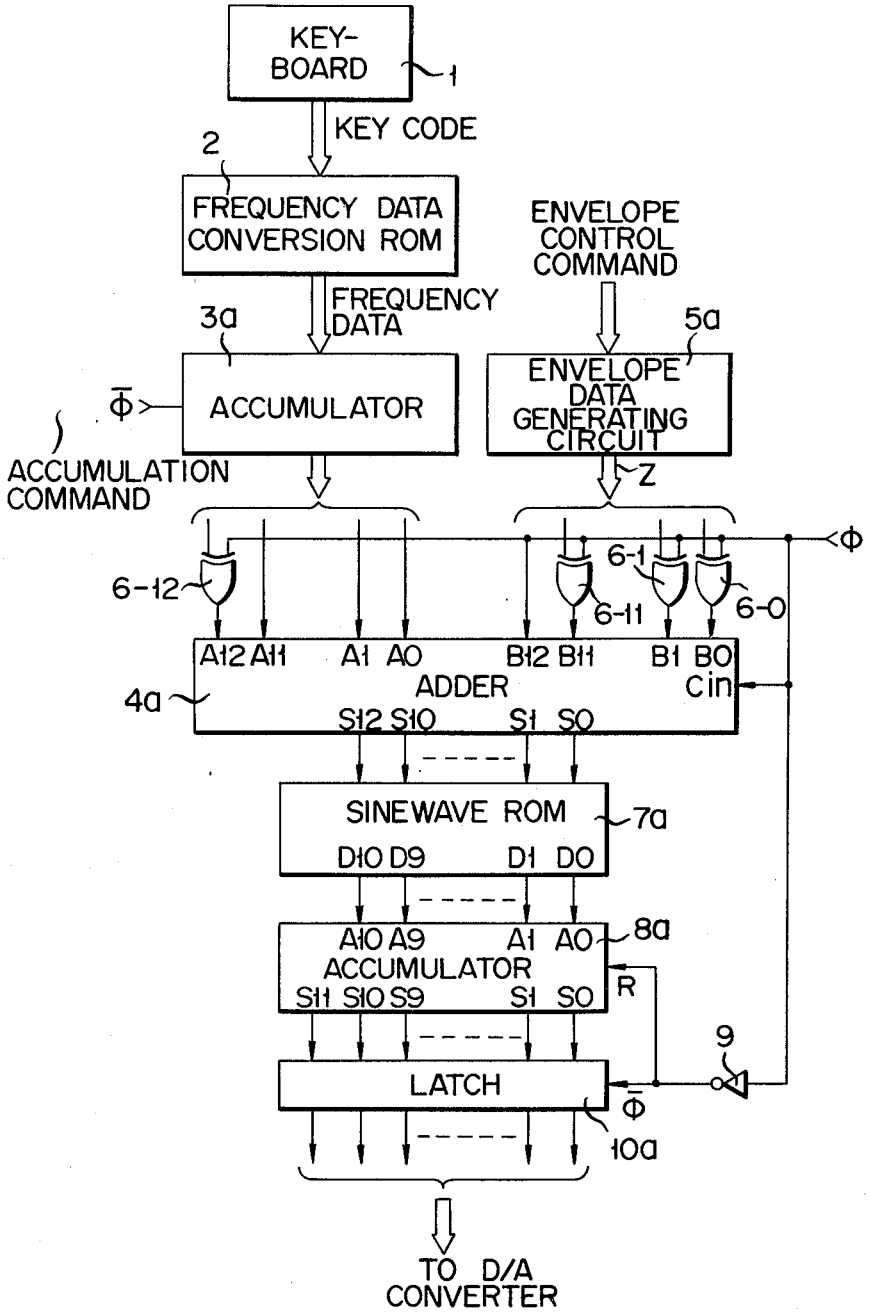
FIG. 8 is a block diagram showing a different embodiment of the invention.

FIGS. 8 to 16 show another embodiment of the invention, which can overcome the drawback mentioned above. FIG. 8 shows the main circuit of this embodiment. In the Figure, like parts as in FIG. 1 are designated by like reference numerals or symbols.

In FIG. 8, accumulator 3*a* provides, for instance, 13-bit data which is fed to A input terminals A12 to A0 of adder 4A. Of these data of 13 bits, only the data of the most significant bit (sign bit) is fed through an exclusive OR gate 6-12 to the A input terminal A12. To B input terminals B11 to B0 to the adder 4*a*, 12-bit data (data Z) from envelope data generating circuit 5*a* is supplied through exclusive OR gates 6-11 to 6-0. Clock $\phi$ is further supplied to the B input terminal B12 (sign bit) and carry input terminal Cin of the adder 4*a*.

The envelope data generating circuit 5*a* generates 12-bit data (i.e., the data Z mentioned above) for the envelope control according to envelope command control data (i.e., attack, decay, sustain and release data) and supplies this data Z to the exclusive OR gates 6-11 to 6-0. This 12-bit data is subjected to the modification of the attack portion and also the modification of the attenuation of the decay and release portions, as will be described in detail. The clock $\phi$ is supplied to one input terminal of each of the exclusive OR gates 6-11 to 6-0 and 6-12.

Thus, when the clock $\phi$ is at "0" level, the adder 4*a* adds 13-bit data supplied to the A and B input terminals and provides the result as 12-bit data from its S output terminals S12 to S0. When the clock $\phi$ is at "1" level, the adder 4*a* adds the same 13-bit data supplied to the A input terminals except that the level of the sign bit is inverted, and data consisting of the same input data to the B input terminal B12 and data obtained by inverting the 12-bit data input to the B input terminals B11 to B0 and incrementing the result by "+1", and then provides the 13-bit result data from the S output terminals.

Figure 9:
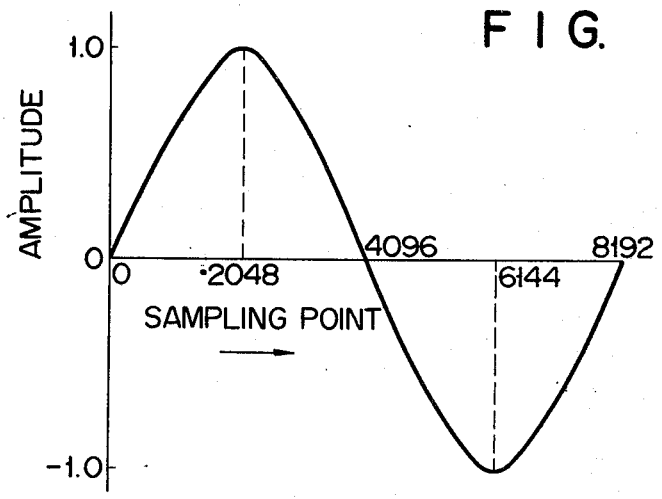
FIG. 9 is a graph showing the relation between the amplitude of the waveform stored in the sine wave ROM shown in FIG. 8 and sampling points.
Figure 10:
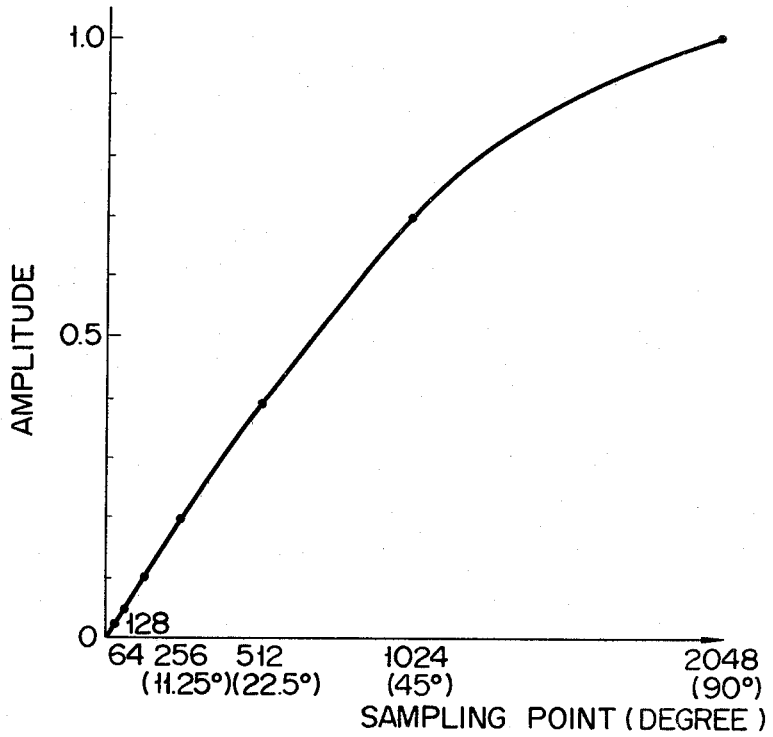
FIG. 10 is a graph showing a detailed view of the waveform of FIG. 9 over a range from 0 to 90 degrees.

The 13-bit data provided from the adder 4*a* is given to sine wave ROM 7*a* for address designation thereof. In the sine wave ROM 7*a*, amplitude values of a sine wave for $2^{13}$ (=8,192) sampling points as shown in FIG. 9 are stored. The sine wave ROM 7*a* provides 11-bit data D10 to D0 as amplitude value data. Of the bits of this data, the most significant bit D10 is a sign bit, and the next to the least significant bits D9 to D0 are bits representing the decimal fraction data. FIG. 10 shows the details of the waveform (amplitude values) of the sine wave shown in FIG. 9 over a phase angle range from 0 to 90 degrees. The waveform for the phase angle range of 90 to 180 degrees. (i.e., $\pi/2$ to $\pi$ in radian scale) is in symmetrical relation to the waveform for the phase angle range of 0 to 90 degrees (0 to $\pi/2$ in the radian scale) with respect to the line corresponding to the phase angle of 90 degrees ($\pi/2$), and the waveform for the phase angle range of 180 to 360 degrees ($\pi$ to $2\pi$) is the same as that obtained by inverting the sign of the waveform for the phase angle range of 0 to 180 degrees (0 to $\pi$).

The 11-bit data from the sine wave ROM 7*a* is supplied to A input terminals A10 to A0 of accumulator 8*a* and accumulated. The accumulator 8*a* provides 12-bit data from its output terminals S11 to S0. Of the bits of this 12-bit data, the most significant bit S11 is a sign bit, the next bit S10 is a second significant bit, and the following bits S9 to S0 are bits representing the decimal fraction data.

Figure 11A:
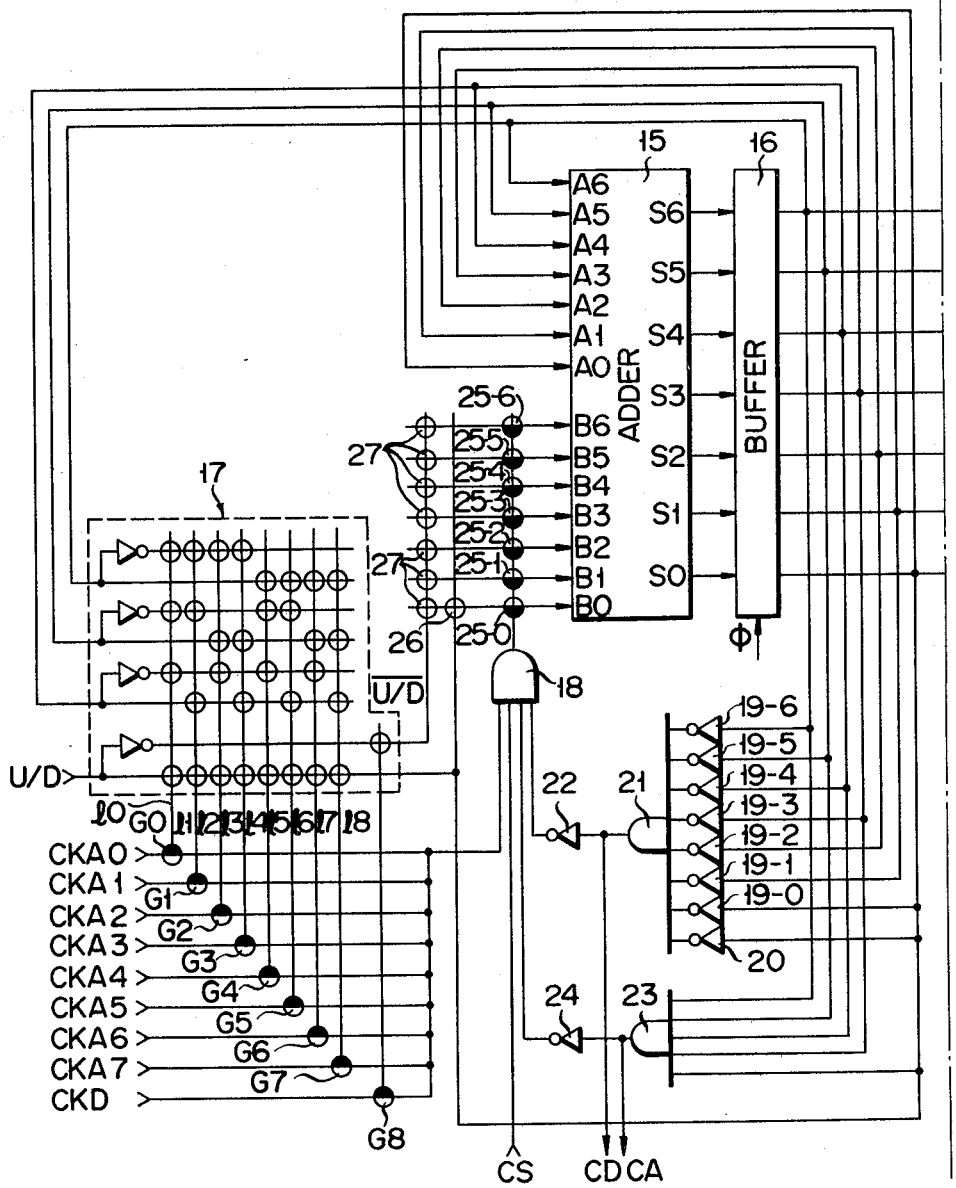
FIGS. 11A and 11B show a block diagram showing the detailed construction of the envelope information generating circuit shown in FIG. 8.
Figure 11B:
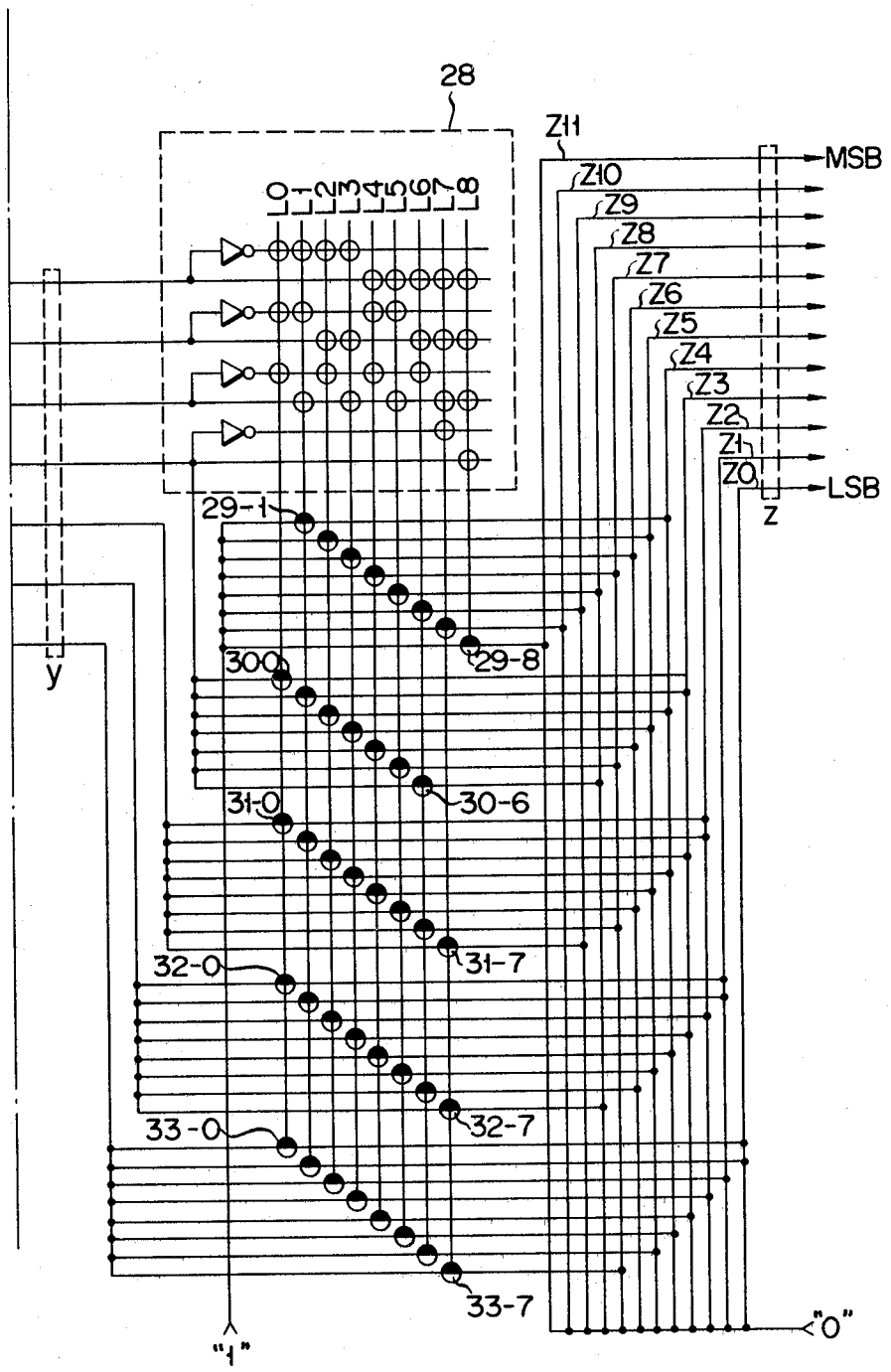

FIGS. 11A and 11B show a specific construction of the envelope data generating circuit 5*a*. The circuit includes an adder 15, which adds 7-bit data supplied to its A and B input terminals A6 to A0 and B6 to B0 and provides the result data (7-bit data) from its S output terminals S6 to S0. To the A input terminals of the adder 15, the result data mentioned above is recirculatedly coupled through a buffer 16, which is controlled for its reading operation by the clock $\phi$, while to the B input terminals clocks CKA0 to CKA7 to be described later in detail are supplied as "+1" data at the output timing of each of the clocks during the attack period of envelope, 7-bit all "1" data is supplied as "−1" data at the output timing of a clock CKD during the decay period, 7-bit all "0" data is supplied during the sustain period, and the clock CKD is supplied as "−1" data at its own output timing during the release period.

Of the aforementioned result data, the upper three bit data S6 to S4 are supplied through the buffer 16 to a decoder 17. To the decoder 17, a single U/D provided from a control section (not shown) is also supplied. The signal U/D is provided as a "1" level signal during the attack period of the envelope, while it is provided as a "0" level signal during the decay, sustain and release periods of envelope, i.e., the attenuating period thereof. During the "1" level period of the signal U/D, successive "1" signals are provided from respective output lines l0 to l7 of the decoder 17 as the result data S6 to S4 mentioned above progressively changes from "000" to "111". These "1" signals enable corresponding gates G0 to G7. During the "0" level period of the signal U/D, a "1" signal is provided from an output line l8 of the decoder 17 to enable a gate G8.

Figure 12:
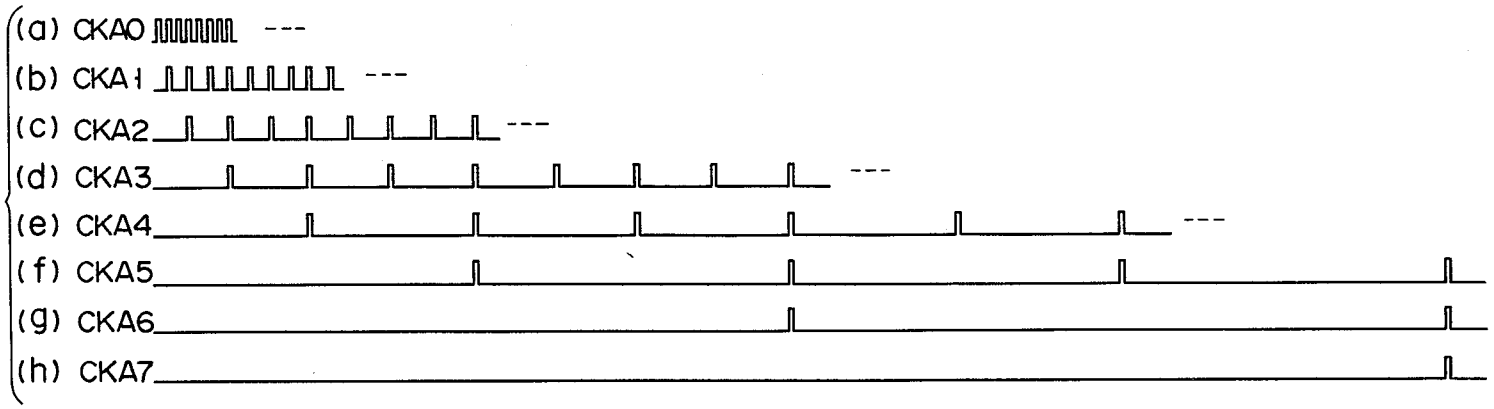
FIG. 12 is a timing chart showing clocks used for the circuit of FIGS. 11A and 11B.

To the gates G0 to G7 are supplied the aforementioned respective clocks CKA0 to CKA7, which are as shown in FIG. 12. To the gate G8 the clock CKD is supplied. During the enabled period of the gates G0 to G8, they pass the respective clocks CKA0 to CKA7 and CKD to an AND gate 18.

As shown in FIG. 12, the clock CKA0 has one half the period (i.e., double the frequency) of the clock CKA1, which has one half the period of the clock CKA2. Likewise, the clocks CKA3 to CKA7 each have double the period of the immediately preceding clocks. The clock CKD, although not shown, has the same frequency as one of the clocks CKA0 to CKA7 or is in a frequency division relation thereto.

The other inputs to the AND gate 18 will now be described. The result data S6 to S0 are coupled through the buffer 16 and respective inverters 19-6 to 19-0 to an AND gate 21. Further, the signal U/D is coupled through an inverter 20 to the AND gate 21. The output signal from the AND gate 21 is sent out as a signal CD to the control section, and is also coupled through an inverter 22 to the AND gate 18.

Of the aforementioned result data the upper four bit data S6 to S3 and the signal U/D are coupled to an AND gate 23, and the output signal therefrom is sent out as a signal CA and also coupled through an inverter 24 to the AND gate 18. Further, a signal CS is sent out from the control section as a "0" level signal during the sustain period and as a "1" level signal during the other period, i.e., the attack, decay and release periods, to the AND gate 18. The output of the AND gate 18 on-off controls gates 25-6 to 25-0 provided on the input side of the B input terminals B6 to B0 of the adder 15. The signal U/D is coupled through an AND gate 26 to the gate 25-0, and a signal U/D is coupled through seven parallel AND gates 27 to the respective gates 25-6 to 25-0.

Figure 13:
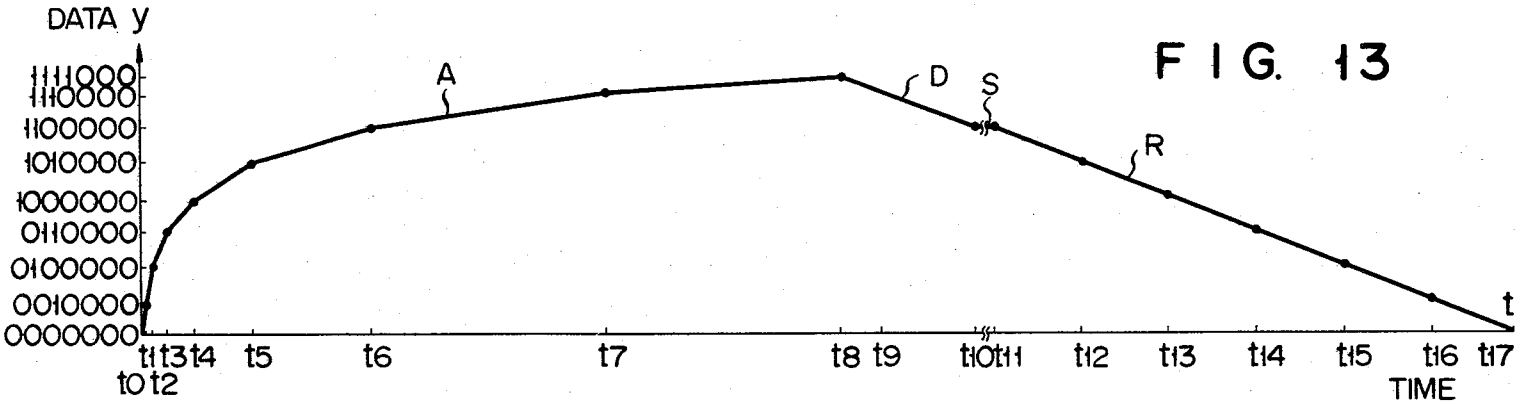
FIG. 13 is a graph showing the waveform of data y shown in FIGS. 11A and 11B.

With the aforementioned input signals to the AND gates 18 and 26 and also the input signals to the AND gates 27, different data are supplied to the B input terminals of the adder 15 for the attack, decay, sustain and release periods, and the output y data from the buffer 16 changes in the manner as shown in FIG. 13. As shown in FIG. 13, the attack portion A of the envelope is modified by the above circuit to an upwardly convex curve which is desirous from the musical point of view.

Figure 14:
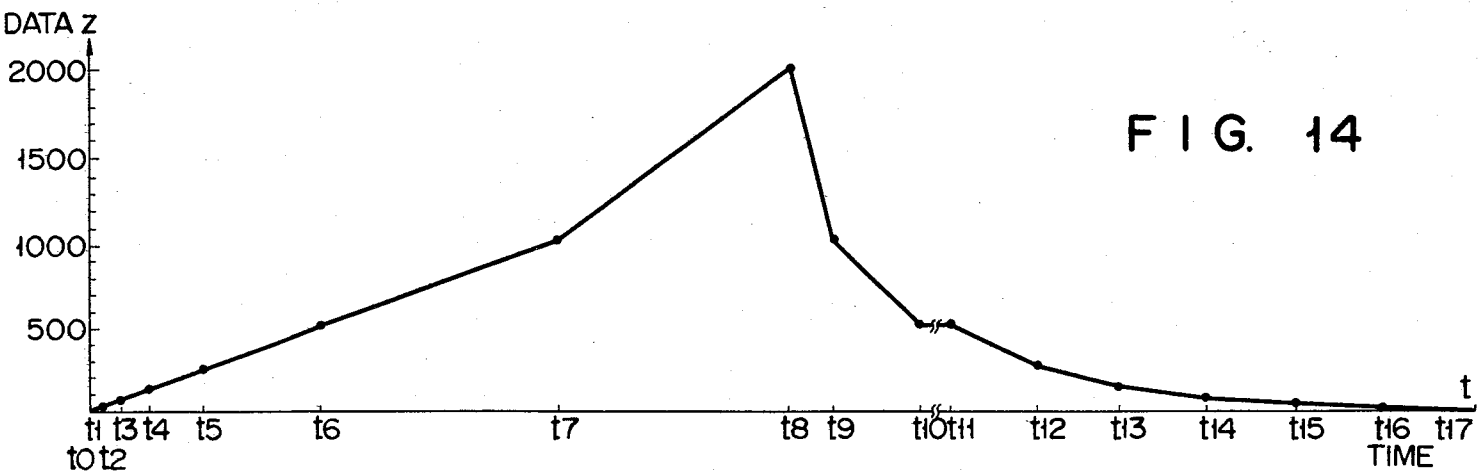
FIG. 14 is a graph showing the waveform of data z shown in FIGS. 11A and 11B.

Now, a circuit for modifying the straight line attenuating envelope curves (for the decay and release portions) of the output data y shown in FIG. 13 into downwardly convex attenuating envelope curves as shown in FIG. 14 will be described.

Of the result data from the adder 15, the upper four bit data S6 to S3 are fed through the buffer 16 to a decoder 28. The decoder 28 provides successive "1" signals from its respective output lines L0 to L6 as the result data S6 to S4 progressively changes from "000" to "110", provides a "1" signal from its output line L7 when the result data S6 to S3 is "1110" and provides a "1" signal from its output line L8 when the result data is "1111".

The output signals from the output lines L1 to L8 on-off control respective gates 29-1 to 29-8 constituting a shifter. The output signals from the output lines L0 to L6 drive respective gates 30-0 to 30-6. Further, the output signals from the output lines L0 to L7 drive respective gates 31-0 to 31-7, 32-0 to 32-7 and 33-0 to 33-7.

Meanwhile, a "1" signal is supplied to the gates 29-1 to 29-8, and the data S3, S2, S1 and S0 of the result data of the adder 15 are supplied to the respective gates 30-0 to 30-6, 31-0 to 31-7, 32-0 to 32-7 and 33-0 to 33-7. The output signals of the gates 29-1 to 29-8 are supplied to respective output lines Z4 to Z11 which provide the data Z. The output signals of the gates 30-0, 30-1 to 30-6 are supplied to the output lines Z3, Z3 to Z8, respectively. The output signals of the gate circuits 31-1, 31-0 to 31-7 are also supplied to output lines Z2 and Z2 to Z9. The output signals of the gates 32-0 to 32-7 are also supplied to the output lines Z1 and Z1 to Z8. The output signals of the gates 33-0 to 33-7 are also supplied to the output lines Z0 and Z0 to Z7. A "0" signal is supplied to the other end of the output lines Z11 to Z0.

With the above construction, the data y shown in FIG. 13 is modified according to the data Z of the waveform as shown in FIG. 14 to obtain desirous attenuating envelope curves.

The operation of this embodiment will now be described. Every time the accumulation command $\phi$ goes to "1", the accumulator 3a accumulates the frequency data corresponding to the operated note key and supplies the result data to the adder 4a.

In the timing T0, in which the data Z from the envelope data generating circuit 5a is directly supplied to the B input terminals of the adder 4a, the adder 4a adds this data A and the data supplied to the A input terminals. In the timing T1, in which the aforementioned accumulation result data is supplied with the level of only the sign bit inverted to the A input terminals, while data as a result of inversion of the level of the individual bits of the data Z and then incrementation of this result by "+1" is supplied to the B input terminals, the adder 4a adds these inputs supplied to the A and B input terminals. The resultant sum data is impressed upon the sine wave ROM 7a in each of the timings T0 and T1.

Thus, the sine wave ROM 7a is generally differently address specified in the timings T0 and T1 and, as a result, the data read out from the ROM 7a in each of these timings is accumulated in the accumulator 8a. The result of accumulation is latched into the latch 10a at the timing of the rising of the clock $\overline{\phi}$.

Now, the operation of the envelope data generating circuit 5a will be described in detail. Before any note key is depressed, the buffer 16 is in the cleared state, and the data y is 7-bit all "0". Also, the signal CS prevails as "1" signals.

When a note key is depressed in the timing T0, the signal U/D goes to "1". As a result, the output of the inverter 20 is changed to "0" to change the output of the AND gate 21 to "0", thus changing the output of the inverter 22 to "1". The output of the AND gate 23 is "0" until the upper four bit data S6 to S3 of the output data S6 to S0 of the adder 15 all become "1", and thus during this period the output of the inverter 24 is "1".

Thus, as soon as the note key is depressed, the AND gate 18 is enabled. Meanwhile, the decoder 17 decodes the output data S6 to S4, and since the data S6 to S4 are "000" at this time, a "1" signal is provided from the output line l0 to enable the gate G0. During the "on" state of the gate G0, the clock CKA0 is thus passed through the AND gate 18 to the gates 25-0 to 25-6.

Since the signal U/D is "1", of the AND gates 26 and 27 only the AND gate 26 is enabled, and the "1" signal is supplied only to the gate 25-0, and a "0" signal is supplied to the gates 25-1 to 25-6. Thus, every time the clock CKA0 appears, data "0000001", i.e., data "+1", is supplied to the B input terminals B6 to B0 of the adder 15 for addition to the data to the A input terminals. Consequently, the sum data S6 to S0 is progressively increased from "0000000" to "0000001", "0000010", . . . . This data is recirculated through the buffer 16 to the A input terminals A6 to A0, and is also provided as the data y to the decoder 28 and gates 29-1 to 29-8, . . . , 33-0 to 33-7.

When 16 pulses of the clock CKA0 are provided so that the sum data S6 to S0 becomes "0010000" at the instant t1, the decoder 17 provides a "1" signal from the output line l1. As a result, the gate G0 is disabled, while the gate G1 alone is enabled. Thus, the clock CKA1 which is of double the period of the clock CKA0 (i.e., at one half the frequency thereof) is supplied to the AND gate 18. Thus, the adder 15 is caused to execute the operation of incrementing with "+1" at one half the rate before. The waveform during the period between the instants t0 and t1 shown in FIG. 13 shows the changes in data y.

Meanwhile, during the period between the instants t0 and t1, the decoder 28 provides a "1" signal only from its output line L0 to enable only the gates 30-0, 31-0, 32-0 and 33-0. Also the sum data S0 to S3 are supplied to the respective output lines Z0 to Z3, and a "0" signal is supplied to the output lines Z4 to Z11. Thus, during the period between the instants t0 and t1 the output data Z undergoes a change of "00000000S3S2S1S0", and the waveform during the period between the instants t0 and t1 as shown in FIG. 14 is obtained.

During the subsequent period between instants t1 and t2, during which 16 pulses of the clock CKA1 are provided, a waveform of the data y as shown in FIG. 13 during this period is obtained. When the sum data S6 to S0 becomes "0100000" at the instant t2, the decoder 17 now provides a "1" signal only from its output line l2 to enable only the gate G2, whereby the clock CKA2 of double the period of the clock CKA1 begins to be supplied to the AND gate 18. Thus, from the instant t2 the adder 15 executes the operation of incrementing with "+1" at one half the rate before.

Meanwhile, during the period between the instants t1 and t2, the decoder 28 provides a "1" signal only from the output line L1 to enable only the gates 29-1, 30-1, 31-1, 32-1 and 33-1. Also, the sum data S0 to S3 of the adder 15 are supplied to the respective output lines Z0 to Z3, a "1" signal is supplied to the output line Z4, and a "0" signal is supplied to the output lines Z5 to Z11. Thus, during the period between the instants t1 and t2 the output data Z shows a change of "00000001S3S2S1S0", and a waveform as shown in FIG. 14 during this period is obtained.

Similar operation is repeatedly executed until an instant t8, at which time the sum data S6 to S0 becomes "1111000". During this period, the decoder 17 starts to provide a "1" signal from the output lines l3 to l7 at the respective instants t3 to t7, causing the respective clocks CKA3 to CKA7 to be successively supplied to the AND gate 18. Thus, the adder 15 starts to execute the operation of incrementing with "+1" at one half the rate before from each of the instants t3 to t7, whereby the waveforms of the data y during the period between the instants t3 and t4, period between the instants t4 and t5, period between the instants t5 and t6, period between the instants t6 and t7 and the period between the instants t7 and t8 as shown in FIG. 13 are obtained.

Meanwhile, during the periods between the instants t2 and t3, period between the instants t3 and t4, period between the instants t4 and t5, period between the instants t5 and t6, period between the instants t6 and t7 and period between the instants t7 and t8, the decoder 28 provides successive "1" signals from the respective output lines L2 to L7. During this period, the output data Z from the output lines Z11 to Z0 is progressively changed to "0000001S3S2S1S0,", "000001S3S2S1S000", "00001S3S2S1S0000", "0001S3S2S1S00000", "001S3S2S1S000000" and "01S2S1S00000000" as shown in FIG. 14.

When the sum data S6 to S0 becomes "1111000" at the instant t8, the output of the AND gate 23 (i.e., signal CA) goes to "1", thus informing the control section of the end of the attack period. Also, the AND gate 18 is temporarily disabled. In response to the signal CA of "1", the control section starts to provide the signal U/D of "0". Thus, the decoder 17 supplies a "1" signal from the output line l8 to enable only the gate G8, thus causing the clock CKD to be supplied to the AND gate 18. At the time of the change of the signal U/D to "0", the output of the AND gate 23 becomes "0" again, causing the output of the inverter 24 to go to "1" again to enable the AND gate 18 again, so that the clock CKD is provided. Meanwhile, with the change of the signal U/D to "0" the signal U/D goes to "1" to enable the AND gates 27, so as to cause a "1" signal to be supplied to the gates 25-6 to 25-0. Thus, after the end of the attack period (i.e., the instant t8) an all "1" signal is supplied to the B input terminals B6 to B0 of the adder 15 at the output timing of the clock CKD. The adder 15 adds the data "1111000" supplied to the A input terminals B6 to B0 and the data "1111111" supplied to the B input terminals B6 to B0, and the result is incremented by "−1" to obtain a data "1110111". By an instant t9, eight pulses of the clock CKD are provided in the above way. During this time, the result data is incremented by "−1" after another, and eventually becomes "1110000". (See FIG. 13).

At the instant t8 the output on the output line L8 of the decoder 28 becomes "1", and the data Z becomes "100000000000" at this instant. From this instant till an instant t9 after the appearance of a first pulse of the clock CKD, a "1" signal is provided from the output line L7. During this period, the data Z is reduced progressively as "01S2S1S00000000". Thus, a waveform during the period between the instants t8 and t9 as shown in FIG. 14 is obtained. This period is one half the period between instants t9 and t11, period between instants t11 and t12, . . . . This means that the attenuation period of the line segment L1 (corresponding to the portion between the instants t8 and t9) is one half the attenuation period of the line segment L2 (corresponding to the portions between the instants t9 and t11, between the instants t11 and t12, . . . ) as has been described earlier in connection with FIG. 6.

During the period between the instants t9 and t10, during which time 16 pulses of the clock CKD are provided, the sum data S6 tp S0 is progressively decremented by "−1" and becomes "1100000" at the instant t10. During this time, during which a "1" signal is provided from the output line L6, the data Z is progressively reduced one by one as "001S3S2S1S000000". When the sum data S6 to S0 becomes "1100000" at the instant t10, this content is detected by the control section, and the signal CS is changed to "0". That is, the current level is held as the sustain level. Thus, the AND gate 18 is disabled to inhibit the supply of clock CKD. The sum data S6 to S0 is thus held at "1100000" to hold the data Z at "001000000000", thus bringing an end to the decay period and starting the sustain period.

When the note key is released at the instant t11, the control section again provides the signal CS of "1" to enable the AND gate 18. Thus, the clock CKD starts to be provided again, and the adder 15 is caused to execute the decrementing operation progressively for each appearance of the clock CKD. More particularly, during periods between instants t11 and t12, between instants t12 and t13, between instants t13 and t14, between instants t14 and t15, between instants t15 and t16, between instants t16 and t17 the upper three bit data S6 to S4 of the sum data S6 to S0 assume respective values "101", "100", "011", "010", "001" and "000". Thus, during the period between the instants t11 and t17, a release waveform of the data y, linearly attenuating at a constant rate as shown in FIG. 13, is obtained.

Meanwhile, during the periods between the instants t11 and t12, instants t12 and t13, instants t13 and t14, instants t14 and t15, instants t15 and t16 and instants t16 and t17, the decoder 28 provides successive "1" signals from the respective output lines L5 to L0. Thus, the data Z successively becomes "0001S3S2S1S00000", "00001S3S2S1S0000", "000001S3S2S1S000", "0000001S3S2S1S00", "00000001S3S2S1S0" and "00000000S3S2S1S0", and a waveform as shown in FIG. 14 is obtained. When the data y becomes all "0", and hence the data Z becomes all "0", at the instant t17, the evelope control operation is ended.

FIg. 15 shows a classification pattern of the attack portion modifying operation and attenuating envelope portion modifying operation of the envelope data generating circuit 5*a* for the individual timings.

The data Z which is changed in the manner as shown in FIG. 14 from the instant of key-on of a note key till the end of the envelope after the key-off, is supplied through the exclusive OR gates 6-11 to 6-0 to the B input terminals of the adder 4*a* for addition to the data supplied to the A input terminals as mentioned earlier.

The above operation will now be described mathematically. The data provided from the accumulator 3*a* is denoted by "a". In the timing T0, during which the data "a" and Z are directly coupled to the respective input terminals A0 to A12 and B0 to B12 of the adder 4*a*, the output of the adder 4*a* is a +Z. With this data supplied to the sine wave ROM 7*a*, the accumulated data input to the accumulator 8*a* is $$\sin 2\pi \frac{a+Z}{2^{13}} = \sin \frac{(a+Z)\pi}{4096} \tag{29}$$

In the timing T1, the most significant bit (sign bit) of the data supplied from the accumulator 3*a* is inverted by the exclusive OR gate 6-12, the individual bits of the data Z supplied from the envelope data generating circuit 5*a* are inverted by the respective exclusive OR gates 6-0 to 6-11, and a "1" signal is supplied to the carry input terminal Cin of the adder 4*a*. Thus, the data accumulated in the accumulator 8*a* is $$-\sin 2\pi \frac{a-Z}{2^{13}} = -\sin \frac{(a-Z)\pi}{4096} \tag{30}$$

Thus, the output of the accumulator 8*a* is $$\sin \frac{(a+Z)\pi}{4096} - \sin \frac{(a-Z)\pi}{4096} = 2\cos \frac{a\pi}{4096} \sin \frac{Z\pi}{4096} \tag{31}$$

It is thus found that with the instant embodiment of the electronic musical instrument the envelope control can be obtained according to the data Z provided from the envelope data generating circuit 5*a* (i.e., data supplied through the exclusive OR gates 6-0 to 6-11 to the B input terminals of the adder 4*a*). The envelope control value in this case is $$2\sin \frac{Z\pi}{4096} \tag{32}$$

Figure 16:
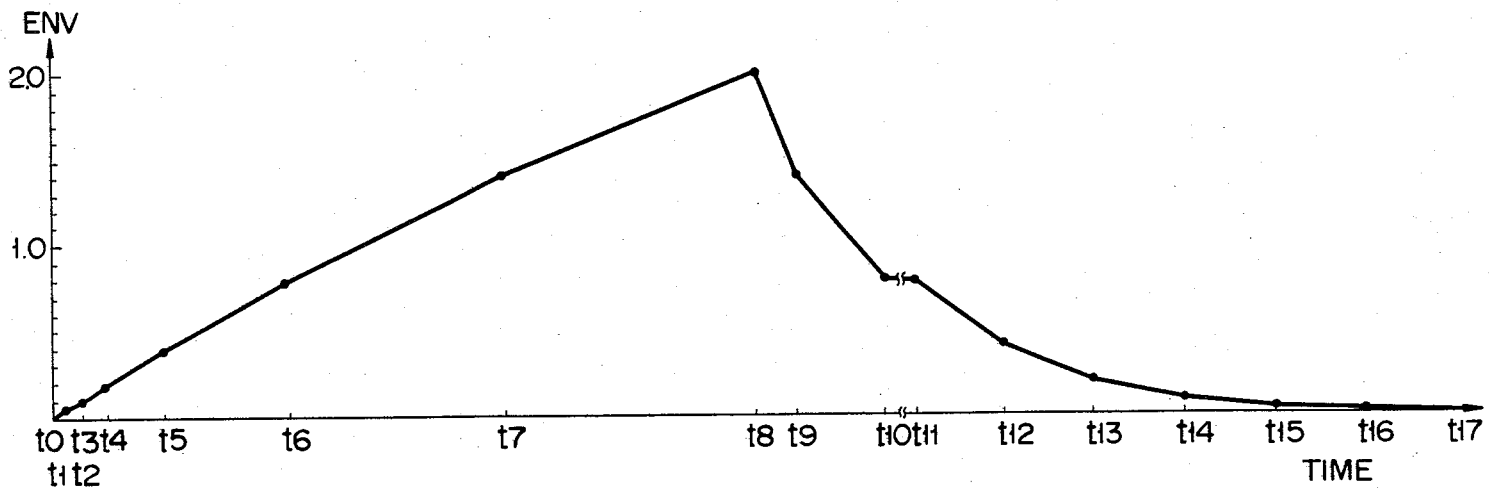
FIG. 16 is a graph showing an envelope waveform based upon data Z shown in FIG. 14.

FIG. 16 shows the values of the equation (32) when incorporated with the data Z shown in FIG. 14. It will be seen that a satisfactory envelope can be obtained with this embodiment.

Now, the envelope control will be described specifically with reference to FIGS. 17A to 17C. In the absence of the envelope waveform when a key is turned on, the data Z provided from the envelope data generating circuit 5*a* is "0". Thus, the amplitude value read out from the sine wave ROM 7*a* in each timing T0 is sin ($a\pi/4096$) as given by the equation (29), while the amplitude value read out from the sine wave ROM 7*a* in each timing T1 is $-\sin(a\pi/4096)$ as given by the equation (30).

Figure 17A:
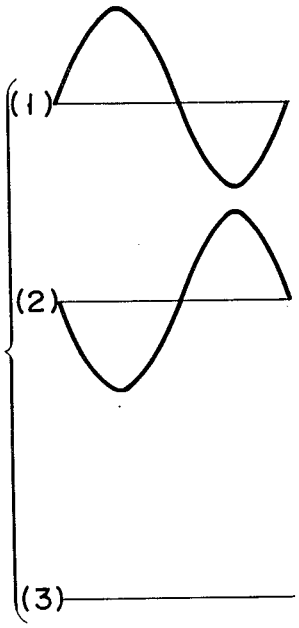
FIGS. 17A, 17B and 17C are graphs showing two waveforms read out from a sine wave ROM and an envelope controlled output waveform obtained from the resultant of these two waveforms.
Figure 17B:
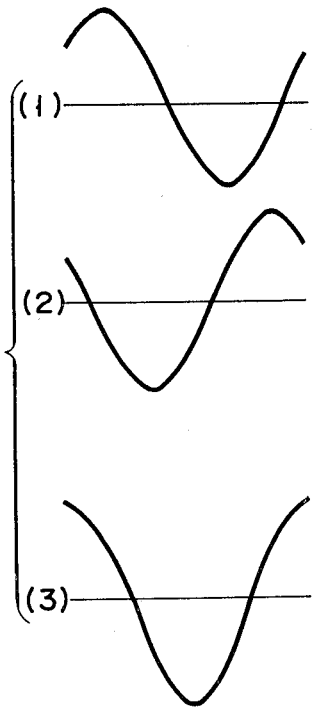

FIG. 17A illustrates this state, with the amplitude read out from the sine wave ROM 7*a* in the timing T0 being shown in (1) and the amplitude value read out from the sine wave ROM 7*a* in the timing T1 being shown in (2). Since the waveforms shown in (1) and (2) in FIG. 17A are out of phase by $\pi$ (180°) from each other, the signs of both the amplitude values are opposite, and the sum of them, i.e., the output of the latch 10*a* represents the absence of waveform as shown in (3) in FIG. 17A.

After the key-on, the output data Z from the envelope data generating circuit 5*a* is gradually increased from the aforementioned state toward "2048" (="0100000000000") to increase the phase difference mentioned above and reduce the amplitude of the output waveform. FIG. 17B shows the state during this time.

Figure 17C:
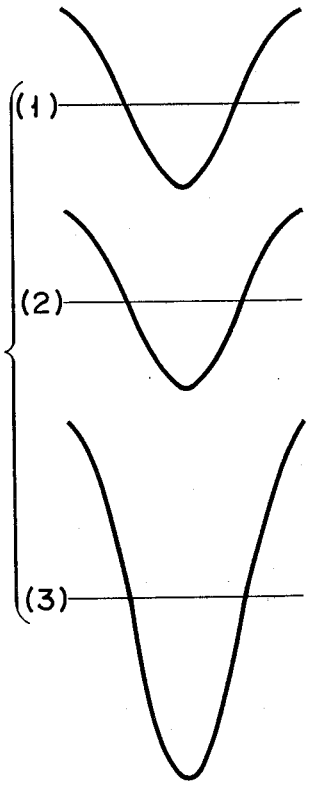

FIG. 17C shows the state when the outut data Z is "2048". In this state, the amplitude data read out from the sine wave ROM 7*a* in the individual timings T0 and T1 are in phase as shown in (1) and (2), and the resultant output waveform has the maximum level (with the amplitude being 2) as shown in (3) in FIG. 17C. This will be obvious from the fact that cos ($a\pi/4096$) in the equation (29) is read out in the timing T0, cos ($a\pi/4096$) in the equation (30) is read out in the timing T1 and the addition of these waveforms yields a waveform given as 2 cos ($a\pi/4096$).

Thus, in the attack portion, during which the output level quickly increases from zero level to the maximum level after a note key is turned on, the output data Z may be quickly increased from "0" to "2048" (see FIG. 14). For providing the decay state after the attack state, the aforementioned data is progressively reduced from 37 2048" to a predetermined value (which is "512" in the instant embodiment). For the sustain state, the data Z is held at the aforementioned predetermined value "512". Thus, the output level is held constant. For the release state, the data Z is gradually reduced from the instant of detection of the keyoff of the note key until it becomes "0". When the data Z is reduced to "0", the output level is also reduced to zero so that the musical sound is no longer produced.

While the above description is concerned with an envelope including the attack, decay, sustain and release states, similar envelope control may also be obtained for an envelope having three distinct state, i.e., attack, sustain and release state or any other envelope.

Further, while in the above embodiment two sine waveforms given by the equations (29) and (30) providing for the equation (31) are read out from the single sine wave ROM 7*a* on a time division basis in two distinct timings T0 and T1, it is possible to read out the two sine waves without any time division by providing two sine wave ROMS, one of these ROMs being adapted to receive the sum of the output data from the accumulator 3*a* and envelope data generating circuit 5*a* and the other ROM being adapted to receive the difference between these data, and an adder for adding the output data from the two sine wave ROMs.

Further, while in the above embodiment the amplitude of a sine wave is stored for $2^{13}=8{,}192$ sampling points in the sine wave ROM 7*a* and read out therefrom, where the sine wave is stored and read out for $2^n$ sampling points, the first and second waveforms read out from the sine wave ROM are given as $$\sin 2\pi \frac{a+Z}{2^n} \tag{33}$$

and $$-\sin 2\pi \frac{a-Z}{2^n} \tag{34}$$

and the resultant waveform is given as $$2\cos\frac{a\pi}{2^{n-1}}\cdot\sin\frac{Z\pi}{2^{n-1}} \quad (35)$$

As a further alternative, where the data "a" and Z are coupled to the A and B input terminals of the adder 4*a* without agency of the exclusive OR gate 6-12, the resultant waveform is given as $$\sin 2\pi\frac{a+Z}{2^{13}}+\sin 2\pi\frac{a-Z}{2^{13}}=2\sin\frac{a\pi}{2^{12}}\cdot\cos\frac{Z\pi}{2^{12}} \quad (36)$$

In this case, the envelope control value is $$2\cos\frac{Z\pi}{2^{12}} \quad (37)$$

Further, it is possible to add gate circuits to the above embodiment such as to obtain the resultant waveform given as $$-\sin 2\pi\frac{a+Z}{2^{13}}+\sin 2\pi\frac{a-Z}{2^{13}}=-2\cos\frac{a\pi}{2^{12}}\cdot\sin\frac{Z\pi}{2^{12}} \quad (38)$$

In this case, the envelope value is $$-2\sin\frac{Z\pi}{2^{12}} \quad (39)$$

It will be seen that various other changes of the calculation system are possible.

Further, while in the above embodiment one period of sine wave is stored in and read out from the sine wave ROM 7*a*, it is possible to read out data for one period of sine wave with a reduced storage capacity by storing, for instance, a quarter or half period sine wave and permitting a round trip access to the memory or inverting the sign of the output waveform. Further, in this case, the difference between the amplitude values at a certain sampling point and the next sampling point, i.e., a point corresponding to the incrementation of the preceding point by "+1", may be stored in addition to the amplitude values at the individual sampling points for the quarter or half period so that the amplitude value and difference may be read out together, and interpolating values at a plurality of sampling points between two adjacent sampling points may be obtained from the difference value mentioned above. By so doing, a more satisfactory sine wave may be obtained without increasing the storage capacity of the sine wave ROM.

Further, while in the above embodiment a sine wave, i.e., fundamental wave, of a note frequency is obtained in accordance with the operation of a corresponding note key, it is possible to obtain a harmonic wave of a given order as well as the fundamental wave through a time division basis process and subjecting the output of the frequency data conversion ROM 2 to a predetermined bit shift. By so doing, it is possible to obtain a desired waveform containing harmonic components.

Further, while in the above embodiment the frequency data corresponding to a given note is obtained according to a corresponding phase angle, it is also possible to generate a clock at a frequency corresponding to the note frequency and progressively increment the waveform memory address according to this clock. In this case, different values may be stored in lieu of amplitude values in the sine wave memory.

Further, while in the above embodiment the modification of the attack portion of the envelope is effected through the switching of the clock frequency, it is also possible to effect the modification of the attack portion by adopting a method of adding a constant value (an additive number) to the counter output for every predetermined timing, in which method the additive number is made variable.

Further, while in the above embodiment a shifter consisting of the gates 29-1 to 29-8, . . . , 33-0 to 33-7 is used for obtaining the attenuating envelope curves, it may be replaced with a shift register, or it is possible to adopt other methods such as switching the clock frequency according to the extent of attenuation.

Further, while in the above embodiment two straight line segments L1 and L2 are used to approximate a sine wave (or cosine wave) as shown in FIG. 6 and are converted to obtain attenuating curves (exponential curves), more than two straight line segments may of course be used to approximate a sine wave (or cosine wave) and converted to obtain exponential curves. In this case, downwardly convex exponential curves may be obtained through such control as to change the attenuation rate (make it higher for increasing envelope values and lower for reducing values) for each line segment.

It is to be appreciated that the attenuating envelope waveforms are modified to downwardly convex exponential waveforms under the control of means for making non-uniform the rate of change of the phase difference between the aforementioned two waveforms, thus permitting generation of musical sound with satisfactory attenuating envelope waveforms from the musical standpoint. Also, it will be seen that by providing the above electronic musical instrument with means for correcting the non-uniform rate of change of the phase difference to a uniform rate for the attack portion of the envelope, further superior musical sound can be produced.

With the electronic musical instrument according to the invention, the multiplier that has hitherto been required for the envelope control can be dispensed with, so that the circuit construction can be extremely simplified. Thus, imprementation with LSI can be facilitated, and also accurate envelope control can be obtained.

In a further embodiment of the invention applied to an electronic musical instrument, a number of chords and harmonics can be readily obtained by adopting a time division basis processing system.

In this embodiment, a plurality of circuits, which produce musical sound in a sinusoidal wave synthesizing system, are provided as respective LSI chips, and the orders and number of harmonics and kinds and number of chords of a harmonic sound that is desired to be produced are specified to the individual LSI chips. With this arrangement, a number of chords and harmonics can be obtained.

Figure 18:
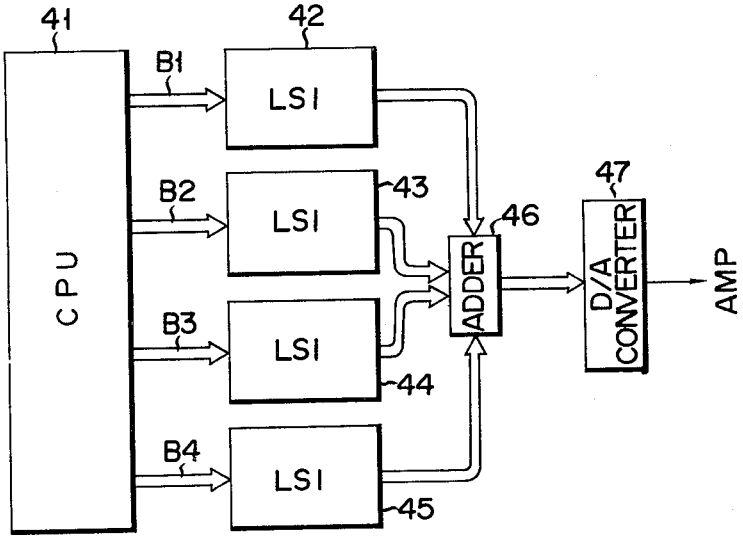
FIG. 18 is a schematic showing a construction obtained by using an LSI according to the invention.

This embodiment will now be described with reference to the drawings. FIG. 18 shows a schematic of the essential part of this embodiment of electronic musical instrument. The system comprises a CPU (central processing unit) 41, which may be a one-chip microprocessor. The CPU 41 provides various data to four LSI chips 42, 43, 44 and 45 through respective bus lines B1, B2, B3 and B4 for controlling the operation of producing musical sound. More particularly, the CPU 41 provides frequency data corresponding to the notes of operated note keys on a keyboard (not shown) and control signals corresponding to the outputs of various external operated switches to the bus lines B1 to B4.

Figure 19:
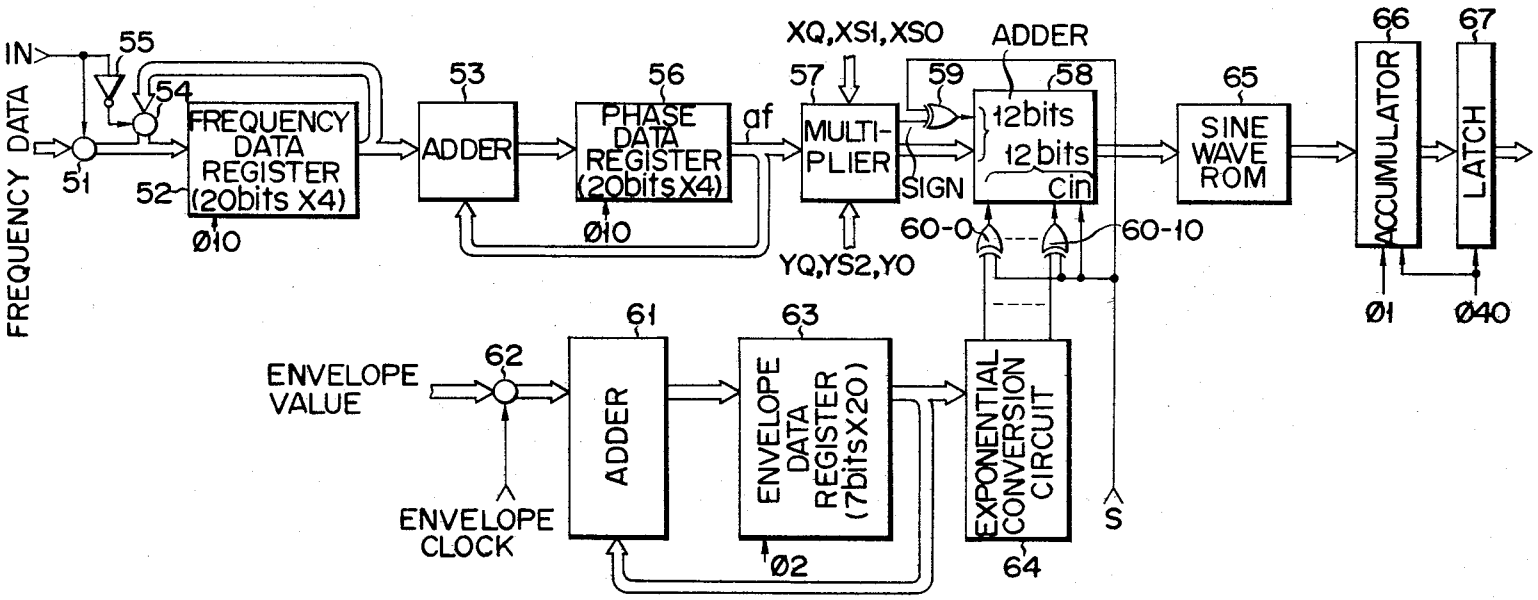
FIG. 19 is a block diagram showing an LSI internal circuit shown in FIG. 18.

The LSI chips 42 to 45 have the same construction including the circuit shown in FIG. 19. These LSI chips 42 to 45 provide waveform data including harmonics of the orders specified by the CPU 41 to an adder 46 where these data are added (i.e., combined). The resultant data is supplied to a D/A converter 47 for conversion into a corresponding analog signal which is coupled through an amplifier and a loudspeaker (not shown) for producing musical sound.

Now, the specific construction of the essential part of the LSI chips 42 to 45 will be described in detail with reference to FIG. 19. Since the LSI chips 42 to 45 have the same construction as mentioned earlier, the LSI 42 will be described as a typical one.

The LSI chip 42 is capable of a 4-channel time division basis processing operation. More particularly, each channel corresponds to one musical sound, that is, the LSI chip 42 can produce at most four musical sounds, i.e., at most a 4-component chord. Thus, various shift registers such as frequency data registers to be described later each have four stages corresponding to the respective four channels. However, an envelope data register has 20 shift stages as will be described later.

Figure 21:
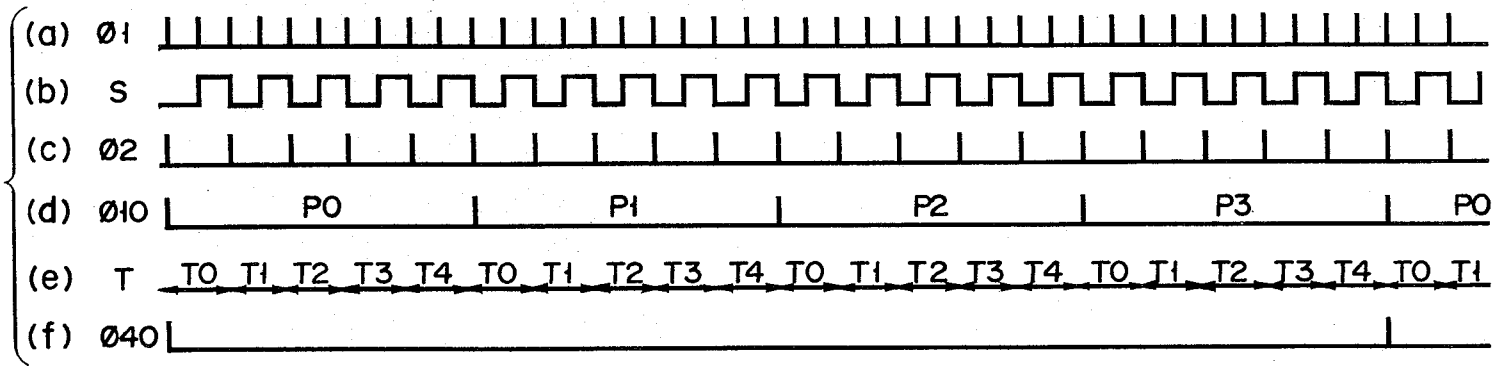
FIG. 21 is a timing chart showing the time division basis operation of the circuit of FIG. 19.

The aforementioned frequency data of operated note keys, which is provided by the CPU 41 according to the notes of the operated note keys on the keyboard and supplied through the bus line B1 is coupled through a gate 51 to a frequency data register 52. This frequency data register 52 is constituted by four cascade-connected 20-bit shift registers and driven by a clock $\phi$10 (as shown in FIG. 21) for shifting operation. The frequency data provided from the 4-th stage shift register of the frequency data register 52 is fed to the adder 53 and is also fed back through a gate 54 to the first shift register of the frequency data register 52. To the gate 51 a control signal IN from the CPU 41 is directly supplied, and it is also fed through an inverter 55 to the gate 54. This control signal IN effects on-off control of these gates. When an operated note key is assigned to a certain channel, the control signal IN is provided as a signal of binary logic level "1" at the timing of that channel. The frequency data corresponding to the operated key is coupled through the gate 51, which is enabled at this time, to the first stage of the frequency data register 52. Meanwhile, the gate 54 is "off" at this time, and the feedback data from the 4-th stage of the frequency data register 52 is interrupted. Subsequently, the control signal IN is provided as "0" signal with the timing of that channel until a channel release occurs in response to the key-off of the operated key. With the control signal IN of "0", the gate 54 is enabled, whereby the frequency data of the operated key is fed back and circulated in the register 52.

The adder 53 adds the frequency data from the frequency data register 52 and phase data (phase address) fed back from a phase data register 56 to provide new phase data fed to the phase data register 56. The phase data register 56 is constituted by four cascade-connected 20-bit shift registers and driven by the clock $\phi$10. The phase data provided from the 4-th stage of the phase data register 56 is fed to a multiplier 57. The adder 53 and phase data register 56 co-operate to accumulate the aforementioned frequency data for obtaining phase address af.

To the multiplier 57, signals XS0, XS1, XQ, Y0, YS2 and YQ are supplied under the control of the CPU 41. The signals XS0, XS1 and XQ are gate control signals for respectively causing the aforementioned phase address af, data of double the phase address af and the result of the previous calculation to an X input terminal of an adder in the multiplier 57. The signals Y0, YS2 and YQ are gate control signals for respectively supplying data "0", data of four times the phase address af and the result of the previous calculation to a Y input terminal of the adder. The output data of the multiplier 57 is fed to a first input terminal group of the adder 58. Of the output data (12-bit data) of the multiplier 57, the most significant bit is a sign bit and is coupled through an exclusive OR gate 59 to the adder 58. To a second input terminal group of the adder 58, envelope data (11-bit data) is coupled through exclusive OR gates 60-10 to 60-0.

Envelope value data is coupled through a gate 62 to an adder 61. The envelope value data is given at the on-off operation of a note key under the control of the CPU 41 according to ADSR (attack, decay, sustain, release) data preset by an external switch, and it is coupled to the adder 61 every time the gate 62 is enabled by an envelope clock.

To the adder 61, data from an envelope data register 63 is fed back. The envelope data register 63 is constituted by 20 cascade-connected 7-bit registers and driven by a clock 2 (as shown in FIG. 21). The adder 61 adds the envelope data and output data of the envelope data register 63 and produces new envelope data (current value of envelope) which is fed to the envelope data register 63. The envelope data is also supplied to an exponential conversion circuit 64. The exponential conversion circuit 64 converts the input envelope data into exponentially changing data such that an ideal envelope waveform having an upwardly convex curve for the attack portion, a downwardly convex curve for the decay portion and a downwardly convex curve for the release portion, and it may be the circuit in the previous embodiment shown in FIGS. 11A and 11B. The envelope data provided from the exponential conversion circuit 64 is coupled through the exclusive OR gates 60-10 to 60-0 to the adder 58.

To the other input terminal of the exclusive OR gate 59 and exclusive OR gates 60-10 to 60-0, is applied a signal S as shown in FIG. 21, being changed to alternate "1" and "0" levels with the appearance of each pulse of a system clock $\phi$1. The signal S is also supplied to the carry input terminal Cin of the adder 58.

Thus, when the signal S is at the "0" level, the adder 58 adds the input data to the first input terminal of the adder 58 and supplies the result as address data to a sine wave ROM 65. When the signal S is at the "1" level, the adder 58 adds data obtained by inverting only the level of the sign bit of the data from the multiplier 57 and data given as 2's complement of the envelope data from the exponential conversion circuit and supplies the result data to the sine wave ROM 65. The sine wave read out when the signal S is "1" and that read out when the signal S is "0" are at the same frequency and shifted in opposite directions by the same amount. Also, they have opposite signs. Their details will be discussed later using mathematical equations.

In the sine wave ROM 65, sine wave amplitude values for $2^n$ (n being a positive integer and $n=2^{12}$ in the instant case) sampling points are stored. The amplitude data read out from the sine wave ROM 65 is fed to an accumulator 66 and accumulated for every pulse of the system clock $\phi$1. The accumulation value data of the accumulator 66 is latched in a latch 67 at the output timing of a clock $\phi 40$ (as shown in FIG. 21) and then supplied to the adder 46 (FIG. 18). The accumulator 66 is cleared at the output timing of the clock $\phi 40$. The accumulation value data latched in the latch 67 is an accumulation of at most 40 sine wave amplitude values.

Figure 20:
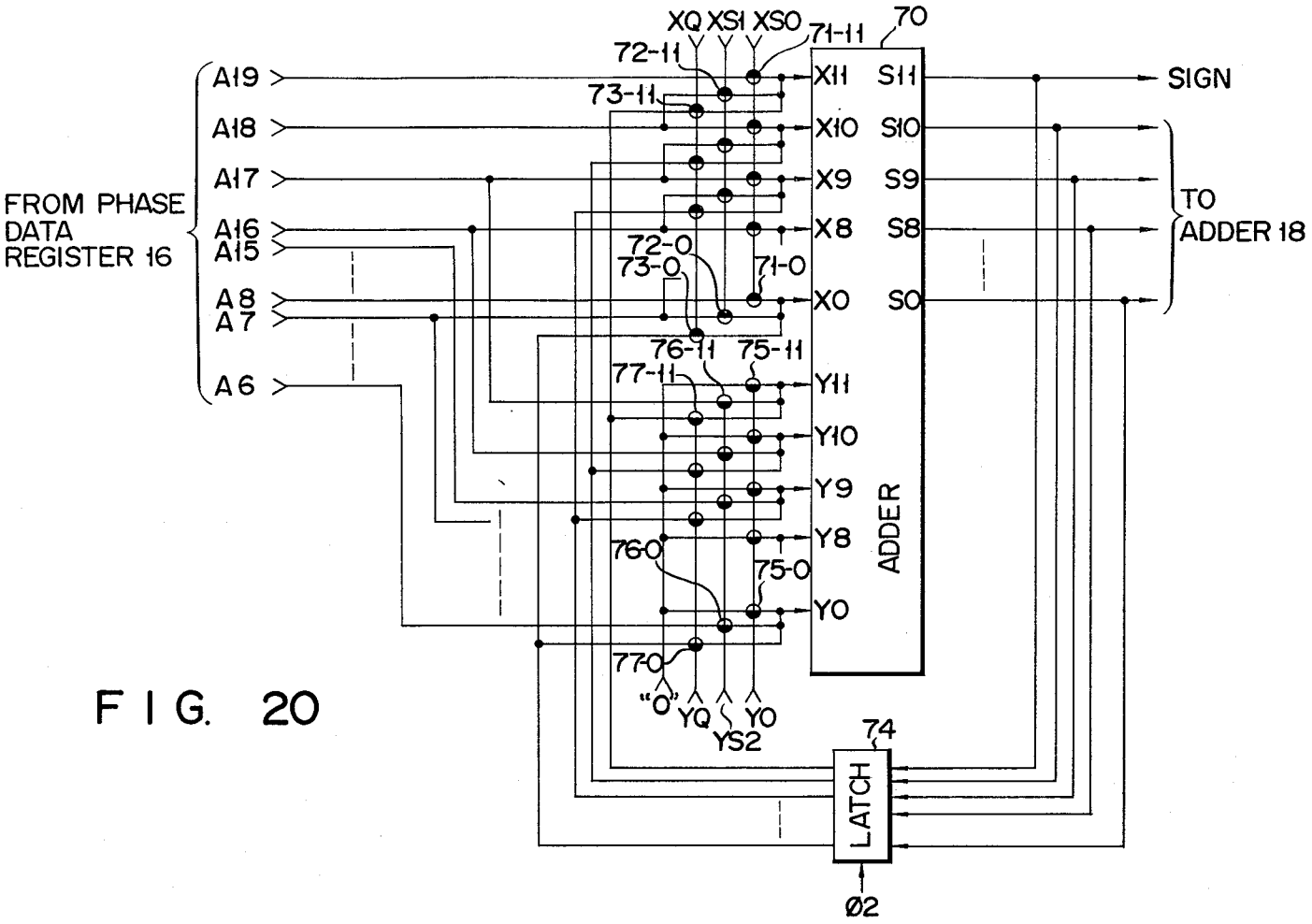
FIG. 20 is a circuit diagram showing a multiplier shown in FIG. 19.

The specific construction of the multiplier 57 will now be described in detail with reference to FIG. 20. To the multiplier 57 are supplied upper 14 bit data A19 to A6 of the phase address af provided from the phase data register 56. The data A19 to A8 are coupled through transfer gates 71-11 to 71-0 to X input terminals X11 to X0 of an adder 70. The data A18 to A7 (which is obtained by upwardly shifting the data A19 to A8 by one bit and represents data *2af* having double the magnitude of the phase address data af) is coupled through transfer gates 72-11 to 72-0 to the X input terminals X11 to X2. Further, the sum data provided from S output terminals S11 to S0 of the adder 70 is latched in a latch 74 and then coupled therefrom through transfer gates 73-11 to 73-0 to the X input terminals X11 to X0.

Meanwhile, all "0" data is supplied through transfer gates 75-11 to 75-0 to Y input terminals Y11 to Y0 of the adder 70. Further, the data A17 to A6 are coupled through transfer gates 76-11 to 76-0 as data corresponding to four times the phase address af. Further, the sum data mentioned above and latched in the latch 74 is coupled through transfer gates 77-11 to 77-0 to the Y input terminals Y11 to Y0.

The transfer gates 71-11 to 71-0, 72-11 to 72-0 and 73-11 to 73-0 are gate controlled by the respective signals XS0, XS1 and XQ. Also, the transfer gates 75-11 to 75-0, 76-11 to 76-0 and 77-11 to 77-0 are gate controlled by the respective signals Y0, YS2 and YQ. The latch 74 is driven by the clock $\phi 2$ to latch the sum data.

With the above construction of the multiplier 57, in response to either one of the signals XS0, XS1 and XQ either the phase address af, double phase address *2af* or previous sum data is fed to the X input terminals X11 to X0 of the adder 70. Meanwhile, either all "0" data, four times the phase address *4af* or previous sum data is fed to the Y input terminals Y11 to Y0 according to either signal Y0, YS2 or YQ. The adder 70 adds the input data fed to the X input terminals X11 to X0 and Y input terminals Y11 to Y0 and provides the resultant sum data from the S output terminals S11 to S0. Thus, by setting the output state of the signals XS0, XS1 and XQ and also the signals Y0, YS2 and YQ under the control of the CPU 41, the multiplier 57 produces address data for a certain fundamental sound and, for instance, four harmonic sounds with respect to that fundamental sound or address data for five harmonic sounds with respect to a certain fundamental sound.

The operation of this embodiment will now be described with reference to FIGS. 21 to 24. Considering now one LSI, for instance the LSI chip 42, up to four different frequency data may be set in the frequency data register 52. For example, when four note keys for the notes C1, D1, E1 and F1 are simultaneously operated, four different frequency data representing the notes of the respective operated note keys are provided from the CPU 41 and coupled through the bus line B1 and gate 51 to the frequency data register 52 to be set in respectively assigned channels thereof. Thereafter, while the operated keys are "on", the individual frequency data are circulated as they are shifted every time a pulse of the clock $\phi 10$ is provided.

Each frequency data is fed to the adder 53 and added to the output data from the phase data register 56 to produce new phase data, i.e., the phase address af for the next step (corresponding to data for addressing the next sampling point in the sine wave ROM 65). This phase address af gives a phase address for the fundamental sounds of the notes C1, D1, E1 and F1. The phase address af is shifted under the control of the clock $\phi 10$ as it is supplied to the adder 53 and multiplier 57.

In the multiplier 57, the signals XS0, XS1 and XQ and signals Y0, YS2 and YQ are set to desired states. For example, they may be set as shown in FIG. 22.

Figure 22:
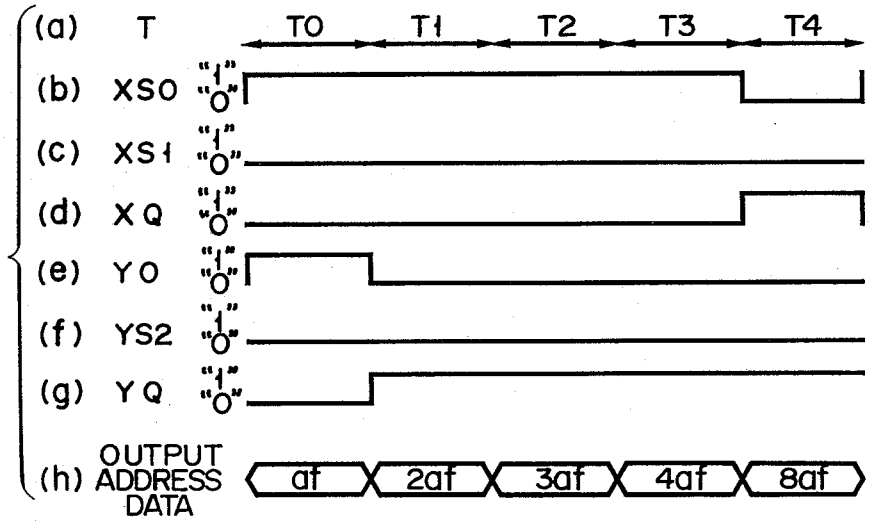
FIGS. 22 to 24 are timing charts for illustrating the operation of the circuit shown in FIGS. 18 and 19.

In FIGS. 21 and 22, labeled P0, P1, P2 and P3 are timings, in which the frequency data register 52 and phase data register 56 operate on a time division basis for the respective channels with the appearance of every pulse of the clock $\phi 10$. Labeled T1, T2, T3 and T4 are timings, in which operation for the respective channels is executed for every pulse of the clock $\phi 2$.

The operation of the multiplier 57 will now be described by taking the case of FIG. 22. In the timing T0 within the timing P0, for instance, the signals XS0 and Y0 are at "1" level while the signals XS1, XQ, YS2 and YQ are at "0" level. Thus, the transfer gates 71-11 to 71-0 are "on" while the other transfer gates 72-11 to 72-0, 73-11 to 73-0 and 77-11 to 77-0 are "off". Thus, the phase address af from the phase data register 56 is supplied to the X input terminals X11 to X0 of the adder 70, and the all "0" data is supplied to the Y input terminals. Thus, the adder 70 provides data af as the sum data from the S output terminals S11 to S0, and this data is fed as address data to the adder 58 and latch 74.

In the timing T1, the signals XS0 and YQ are at "1" level while the signals XS1, XQ, Y0 and YS2 are at "0" level. Thus, the phase address af is supplied to the X input terminals X11 to X0 to enable the transfer gates 77-11 to 77-0. Thus, the sum data in the preceding timing T0 stored in the latch 74, i.e., data af, is supplied, and data 2f is provided as the new sum data from the S output terminals S11 to S0.

In the timing T2 the output states of the signal XS0 and other signals is the same as in the timing T1. Thus, the data af is supplied to the X input terminals of the adder 70 while the preceding sum data *2af* is supplied to the Y input terminals Y11 to Y0, and the new sum data is *3af*.

In the timing T3, the output state of the signal XS0 and other signals is again the same as in the timings T1 and T2. Thus, the data af is supplied to the X input terminals X11 to X0 of the adder while the preceding sum data is supplied to the Y input terminals Y11 to Y0, and the new sum data is *4af*.

In the timing T4, the signals XQ and YQ are at "1" level while the signals XS0, XS1, Y0 and YS2 are at "0" level. Thus, the sum data *4af* in the preceding timing T3 is supplied through the transfer gates 73-11 to 73-0 to the X input terminals X11 to X0 and also to the Y input terminals Y11 to Y0, and the new sum data is *8af*.

Similar operations are of course performed in the multiplier 57 for the other timings P1 to P3 as well.

To the adder 61 envelope values for attack, decay, sustain and release are fed through the gate 62 at timings corresponding to the operation of turning on and off individual keys for the notes C1, D1, E1 and F1. The adder 61 accumulatively adds the input envelope value and output data of the envelope data register 63 to produce new envelope data supplied to the envelope data register 63. The envelope data in the envelope data register 63 is shifted under the control of the clock $\phi 2$, and new exponential conversion envelope data is provided from the exponential conversion circuit 64 in each of the timings T0 to T4. This envelope data is fed through the exclusive OR gates 60-10 to 60-0 to the adder 58.

In the adder 58, different calculations are performed for the "0" and "1" levels of the signal S in each of the timings T0 to T4 in the timing P0. More particularly, in the timing T0 the aforementioned data (address data) af is supplied from the multiplier 57 to the first input terminal group of the adder 58. When the signal S is at the "0" level, the sign bit of the data af is directly supplied, while with the "1" level of the signal S the sign bit is inverted before being supplied.

To the second input terminal group of the adder 58, the envelope data from the exponential conversion circuit 64 is directly supplied when the signal S is at the "0" level, while when the signal S is at the "1" level a 2's complement of the aforementioned envelope data is supplied.

In the timing T0 within the timing P0, the adder 58 adds the data af and envelope data to produce the sum data for addressing the sine wave ROM when the signal S is at the "0" level. When the signal S is at the "1" level, the adder adds data obtained as a result of inversion of the sign of the data af and 2's complement of the envelope data to produce the sum data for addressing the sine wave ROM 65. If the timing P0 is assigned as the time division basis process timing for the note key for the note C1, in the timing T0 two different sine waves are read out with the note C1 as a fundamental sound. These sine waves are opposite in polarity, have the same frequency and oppositely shifted by the same amount.

In the timing T1 within the timing P0, data *2af* is supplied to the first input terminal group of the adder 58. In this timing, the input data *2af* is processed in the same manner when the signal S is at the "0" and "1" levels as in the timing T0. Also, the same envelope data as in the timing T0 is supplied to the second input terminal group of the adder 58. Thus, in this timing T1, two different sine waves of twice the note C1 are read out from the sine wave ROM 65.

In the timings T2, T3 and T4 within the timing P0, data *3af*, *4af* and *8af* are respectively supplied to the first input terminal group of the adder 58, while similar envelope data are supplied to the second input terminal group. Thus, in the timings T2 to T4 two different sine waves of three, four and eight times the note C1 respectively are read out.

If the timings P1, P2 and P3 are assigned as the time division basis process timings for the note keys of the respective notes D1, E1 and F1, within these timings P1 to P3 two different sine waves of the fundamental sounds of the respective notes D1, E1 and F1 and twice, three times and four times these fundamental sounds are respectively read out.

The sine wave data read out from the sine wave ROM 65 is accumulated in the accumulator 66 for every output timing of the clock $\phi 1$. More particularly, within the timing P0, in the timing T1 two pulses of the clock $\phi 1$ are provided two different sine waves of the fundamental sound (of the note C1) are accumulated. In the next timing T1, two different sine waves of twice the accumulated value are accumulated. Likewise, in the timings T2, T3 and T4 two different sine waves of respective three, four and eight times the previously accumulated values are accumulated.

In the timing P1, two different sine waves of the fundamental sound of the note D1 and twice, three times, four times and eight times the fundamental sound are accumulated in the accumulator 66. Likewise, in the timings P2 and P3, two different sine waves of the fundamental sound of the respective notes E1 and F1 and twice, three times, four times and eight times the fundamental sound are accumulated in the accumulator 66.

A total of 40 sine waves (i.e., two different waves times four chords (including the fundamental sound) times five) accumulated in the accumulator are transferred to the latch 67 at the output timing of the clock $\phi 40$ and supplied to the external adder 46 (FIG. 18). It will thus be seen that the sampling clock $\phi 40$ of the electronic musical instrument is the clock $\phi 40$. The accumulator 26 accumulates all the resultant data of the time division basis processes in the timings P0 to P3, and transfers the accumulation content to the latch 67 while clearing the content of itself at the output timing of the clock $\phi 40$.

The operation of the other LSI chips 43 to 45 are basically the same as the LSI chip 42 described above. As has been mentioned earlier, the LSI chips 42 to 45 each provide five different harmonic sounds, and up to four different musical sounds can be simultaneously produced, that is, four different chords each consisting of five harmonic sounds can be simultaneously produced. Thus, with this embodiment it is possible to produce various combinations of chords by using all the four LSI chips 42 to 45, (A) four chords each consisting of twenty harmonics, (B) eight chords each consisting of ten harmonics and (C) sixteen chords each consisting of five harmonics.

In the case (A) of four chords each consisting of twenty harmonics, the four different musical sounds are assigned to the respective LSI chips 42 to 45. In this case, the same frequency data corresponding to the same note are set in the individual channels of the frequency data registers 52 in the LSI chips 42 to 45.

Within the timing T0 in P0, the control signals XS0 and Y0 are provided as "1" signals while the other control signals are provided as "0" signals to obtain phase data af in the multiplier 57. In the following timings the signals XS0 and YQ are supplied as "1" signals while the other control signals are supplied as "0" signals.

With this setting of control signals, phase data of *2af*, *3af*, *4af* and *5af* are obtained from the multiplier in the respective timings T1 to T4 within P0. In the next timing P1, the phase data af corresponding to the same note is continually supplied from the phase data register 56, and phase data *6af*, *7af*, . . . corresponding to the same note are obtained from the multiplier 57.

In this way, for the channels of P0 to P3, phase data af to *20af* are obtained for the same note. Thus, a musical sound containing 20 different harmonics (fundamental sound) are provided from the LSI chips 42 to 45, that is, a state of sound production of four chords by 20 harmonics can be obtained.

Figure 23:
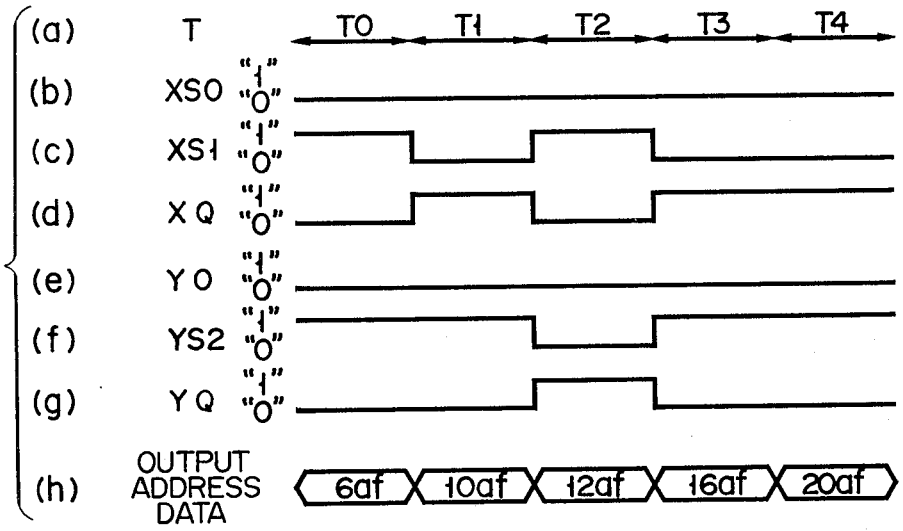

In the case (B) of eight chords by 10 harmonics, the LSI chips 42 and 44, for instance, are paired together, and the LSI chips 43 and 45 are paried. The LSI chips 42 and 44 are operated such as to produce four chords, and the LSI chips 43 and 45 are operated such as to produce four chords different from the four chords produced by the LSI chips 42 and 44. The LSI chips 42 and 43 are set to generate, for instance the fundamental, second, third, fourth and eighth harmonics, and the LSI chips 44 and 45 are set to generate the sixth, tenth, twelfth, sixteenth and twentieth harmonics. In this case, it will be seen that the control signals in the multiplier 57 may be controlled by the CPU 41 as shown in FIG. 22 for the LSI chips 42 and 43 and as shown in FIG. 23 for the LSI chips 44 and 45. Thus, eight different chords each consisting of ten harmonics are produced from the four LSI chips 42 to 45.

Figure 24:
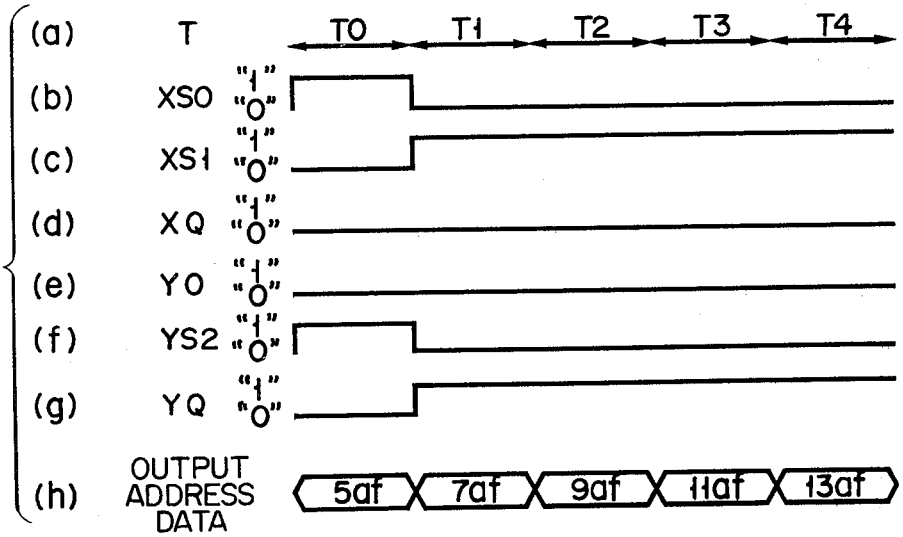

For example, where the LSI chips 44 and 45 are set such as to produce the fifth, seventh, nineth, eleventh and thirteenth harmonics, the operation of the multiplier 57 may be controlled in the manner as shown in FIG. 24.

In the case (C) of sixteen chords each consisting of five harmonics, the LSI chips 42 to 45 may be set such that they each produce four different chords each consisting of five harmonics (as shown in FIG. 22). Thus, in combination sixteen chords each consisting of five harmonics may be produced from the four LSI chips 42 to 45.

The above operation will now be described by using mathematical equations. The envelope data provided from the exponential conversion circuit 64 is denoted by E. This being done so for the sake of the simplicity harmonic sounds. If the value E is varied, it is possible to select the tone color or to vary the content of the harmonics with respect to time. Taking the LSI chip 42, in the timing T0 within the timing P0, when the signal S is at the "0" level data af is supplied to the first input terminal group of the adder 58 while the envelope data E is supplied to the second input terminals. Thus the sum data is af+E, which is fed to the sine wave ROM 65. Thus, the data read out for accumulation in the accumulator 66 is $$\sin 2\pi \frac{af+E}{2^n} \tag{40}$$

where n is the number of sampling points.

When the signal S goes to the "1" level in the timing T0, data as a result of the inversion of the sign of the data af is supplied to the first input terminal group of the adder 58, while 2's complement of the envelope data E is supplied to the second input terminal group. Thus, the sine wave read out from the sine wave ROM 65 is $$-\sin 2\pi \frac{af-E}{2^n} \tag{41}$$

Thus, the accumulation value of the accumulator 66 at the time of the end of the timing T0 is $$\sin 2\pi \frac{af+E}{2^n} - \sin 2\pi \frac{af-E}{2^n} = 2\cos \frac{af\pi}{2^{n-1}} \cdot \sin \frac{E\pi}{2^{n-1}} \tag{42}$$

In the timings T1 to T4 the data *2af, 3af, 4af* and *8af* are respectively supplied to the first input terminal group of the adder 58. Thus, at the end of the timings T1 to T4, the respective accumulation values given by the equation (43) to (46) are progressively accumulated with respect to the accumulation value given by the equation (42). Mathematically, $$\sin 2\pi \frac{2af+E}{2^n} - \sin 2\pi \frac{2af-E}{2^n} = 2\cos \frac{2af\pi}{2^{n-1}} \cdot \sin \frac{E\pi}{2^{n-1}} \tag{43}$$

-continued $$\sin 2\pi \frac{3af+E}{2^n} - \sin 2\pi \frac{3af-E}{2^n} = 2\cos \frac{3af\pi}{2^{n-1}} \cdot \sin \frac{E\pi}{2^{n-1}} \tag{44}$$

$$\sin 2\pi \frac{4af+E}{2^n} - \sin 2\pi \frac{4af-E}{2^n} = 2\cos \frac{4af\pi}{2^{n-1}} \cdot \sin \frac{E\pi}{2^{n-1}} \tag{45}$$

and $$\sin 2\pi \frac{8af+E}{2^n} - \sin 2\pi \frac{8af-E}{2^n} = 2\cos \frac{8af\pi}{2^{n-1}} \cdot \sin \frac{E\pi}{2^{n-1}} \tag{46}$$

Thus, for the musical sound with the note C1 as the fundamental sound in the timing P0, the fundamental sound and second, third, fourth and eighth harmonics are envelope controlled by the envelope data E. The fundamental sound and individual multiple sounds thus have envelope control values given as $$\sin \frac{E\pi}{2^{n-1}} \tag{47}$$

Similar envelope control of the base fundamental and multiple sounds are effected for the individual musical sounds in the other timings P1 to P3 under entirely the same circumstances. Of course, the same thing applies to the other LSI chips 43 to 45.

Now, the method of envelope control based on the equation (47) will be discussed. When no waveform is present in the key-on state, the envelope data E may be made "0". As the envelope data E is gradually increased after the key-on, the attack portion of the envelope with the output level increasing gradually is formed. After the output level becomes maximum, the envelope data E is gradually reduced to form the decay portion. At the end of the decay portion, the envelope data E is held constant to provide the sustain state. After the key-off the envelope data E may be gradually reduced down to zero for forming the release portion.

While the above discussion is concerned with an envelope having the attack, decay, sustain and release states, similar envelope control may also be obtained for an envelope having three envelope states, i.e., attack, sustain and release states or for any other envelope.

Further, while in the above embodiment the individual LSI chips are adapted to execute a time division basis process for at most four channels, this number of channels is of course not limitative. Further, while in the above embodiment four LSI chips of the same construction are used, it is possible to provide any desired number of LSI chips according to the numbers of chords and harmonics produced. Further, the arrangement of the transfer gates in the adder 70 may be appropriately modified, and thus it is possible to realize any other combination of address data than those shown in FIGS. 22 to 24.

Further, while in the above embodiment the outputs of the LSI chips 42 to 45 are combined in the external adder 46, it is also possible to provide the adder 46 within the LSI chips and let data be transferred to an adder in one of the LSI chips. By so doing, the external circuitry can be reduced.

It is to be appreciated that with the above embodiment the circuit construction can be simplified compared to the prior art electronic musical instrument, and also implementation with LSI can be readily obtained. Further, accurate envelope control can be obtained. Still further, a number of musical sounds containing a number of harmonics can be simultaneously produced, thus facilitating the chord performance and improving the performance effect.

Further, since a plurality of LSI chips are used to construct a circuit for producing musical sound in the sinusoidal wave synthesis system and it is possible to specify the number and orders of harmonics and kinds of chords to be produced from the LSI chips, a number of musical sounds containing a number of harmonics can be readily simultaneously produced, so that musical sound closer to the natural sound can be obtained. Further, chord performance can be further facilitated. Further, since it is necessary to fabricate only a number of LSI chips of the same construction, the design can be facilitated, and cost reduction by mass production can be realized.

Figure 25:
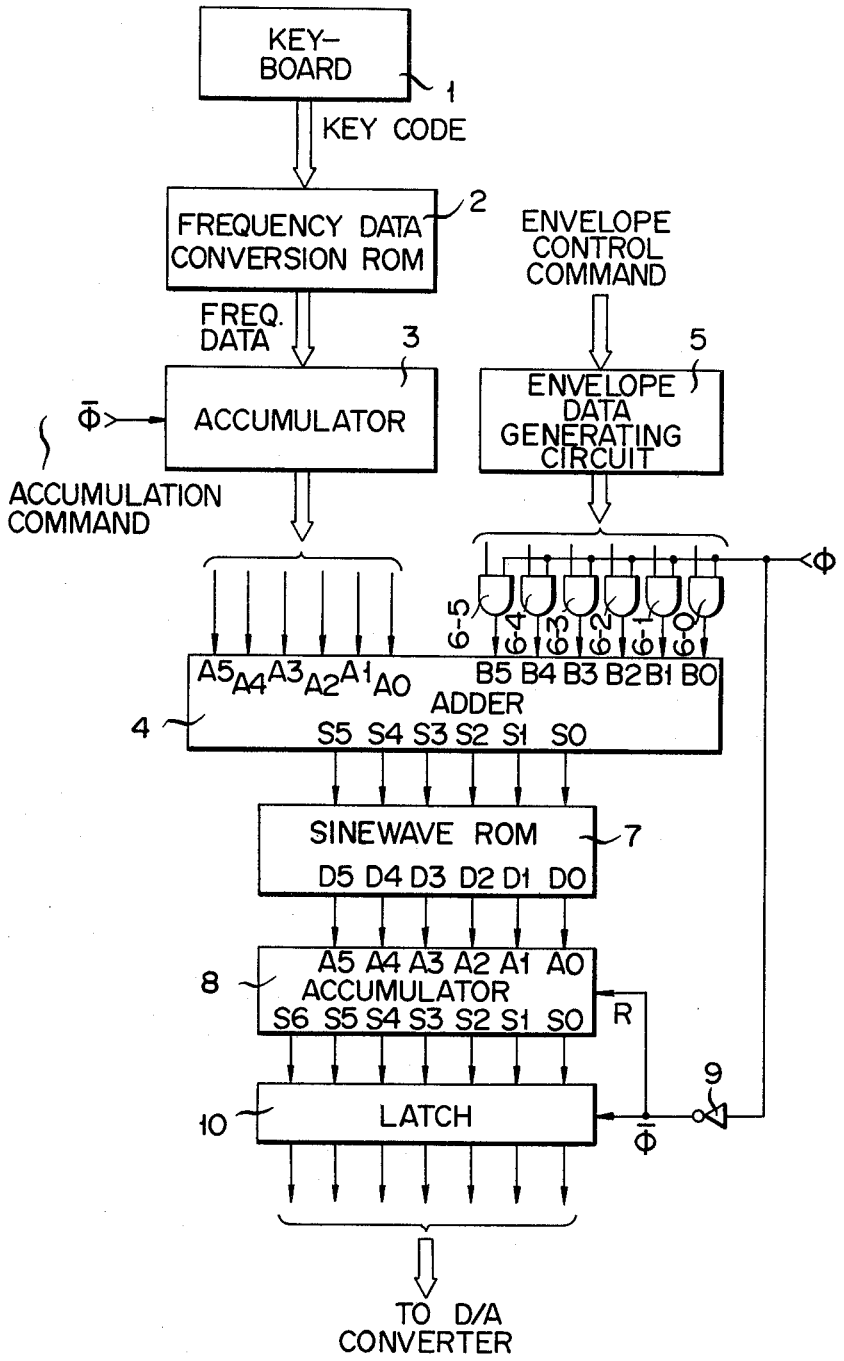
FIG. 25 is a block diagram showing a further embodiment of the invention.

FIG. 25 shows the main circuit of a further embodiment of the invention. In the Figure, like parts as those in FIG. 1 are designated by like reference numerals or symbols. This embodiment is different from the embodiment of FIG. 1 in that the 6-bit data from the envelope data generating circuit 5 is supplied to the B input terminals B0 to B5 of the adder not through exclusive OR gates but through AND gates 6-0 to 6-5 and that clock $\phi$ is supplied to the adder 4.

In the timing T0, the AND gates 6-0 to 6-5 are "off" and the data supplied to the B input terminals of the adder 4 are all "0". Thus, the adder 4 provides the data input to the A input terminals as the output from the S output terminals. In the timing T1, during which the AND gates 6-0 to 6-5 are "on", the adder 4 adds the data input to the A and B input terminals and supplies the resultant sum data from the S output terminals.

The operation of this embodiment will now be described by using mathematical equations. The amplitude value read out from the sine wave ROM 7 in the timing T0 is given as $$\sin 2\pi \frac{a}{2^6} = \sin \frac{a\pi}{32} \tag{48}$$

where "a" is the data supplied to the A input terminals of the adder 4.

In the timing T1 the amplitude value read out from the sine wave ROM 7 is given as $$\sin 2\pi \left( \frac{a}{2^6} + \frac{b}{2^6} \right) = \sin \frac{(a+b)\pi}{32} \tag{49}$$

where b is the data input to the B input terminals of the adder 4.

Thus, the output of the accumulator 8 is $$\sin 2\pi \frac{a}{2^6} + \sin 2\pi \left( \frac{a}{2^6} + \frac{b}{2^6} \right) = 2\sin \frac{\pi}{32} \left( a + \frac{b}{2} \right) \cos \frac{\pi}{32} \cdot \frac{b}{2} \tag{50}$$

Thus, it will be seen that the envelope control is effected according to the data supplied to the B input terminals of the adder 4. The envelope control value in this case is $$2\cos \frac{\pi}{32} \cdot \frac{b}{2} \tag{51}$$

Now, specific examples of the envelope control will be discussed with reference to FIGS. 26A to 26C. When there is no waveform output at an instant of key-on, the adder 4 provides address data for making progressive access to the sine wave ROM 7 as data is supplied to the A input terminals of the adder 4 in each timing T0. In each timing T1, data "32" (=100000) is supplied to the B input terminals of the adder 4. In this timing, data as a result of adding the data "32" to the data input to the A input terminals is provided from the adder 4.

Figures 26A, 26B, 26C:
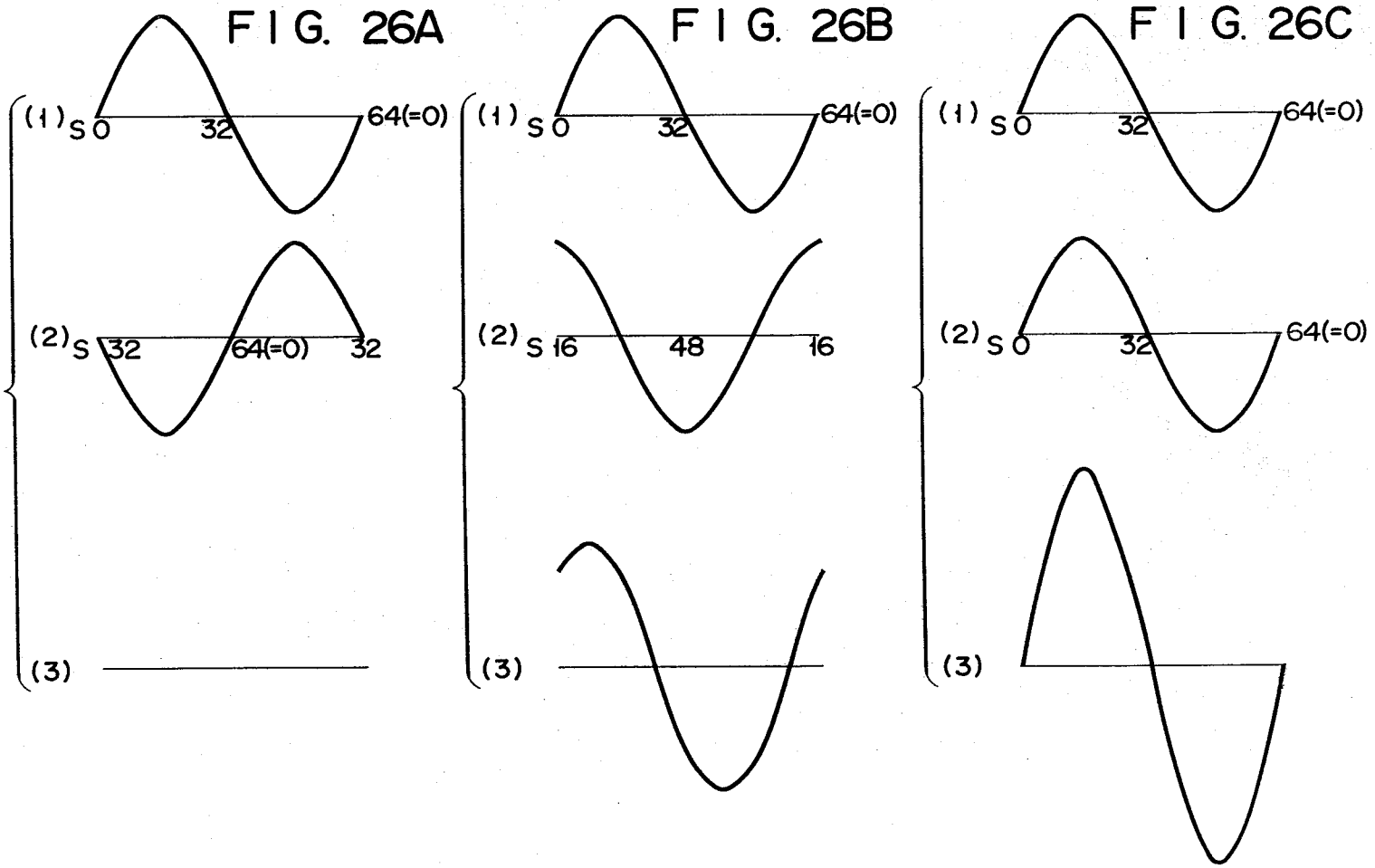
FIGS. 26A, 26B and 26C are graphs showing two waveforms read out from a waveform memory shown in FIG. 25 and an envelope controlled output waveform obtained from the resultant of the two waveforms.

FIG. 26A shows this state. Shown in (1) is the data provided from the sine wave ROM 7 in the timing T0, and shown in (2) is the data provided from the sine wave ROM 7 in the timing T1. These data shown in (1) and (2) in FIG. 26A are out of phase from each other by $\pi$, and thus the sum data, i.e., output data of the latch 10 represents no waveform as shown in (3).

As the data "32" supplied to the B input terminals of the adder 4 is gradually reduced, the amplitude of the output waveform is progressively increased. FIG. 26B shows a state when the data supplied to the B input terminals of the adder 4 is "16". More particularly, shown in (1) and (2) are data output of the sine wave ROM 7 in the respective timings T0 and T1, and shown in (3) is the output data of the latch 10.

FIG. 26C shows a state when the data supplied to the B input terminals of the adder 4 is reduced to "0". In this case, the data read out from the sine wave ROM 7 in the timing T0 as shown in (1) and the data read out from the sine wave ROM 7 in the timing T1 as shown in (2) are the same, and the output waveform amplitude level is maximum as shown in (3). In other words, the waveforms shown in (1) and (2) are entirely in phase, and double the amplitude level is provided as the output.

Thus, for quickly raising the output level from zero level to the maximum level after a note key is turned on, the data supplied to the B input terminals of the adder 4 may be quickly reduced from "32" to "0". For the decay state subsequent to this attack state, the data supplied to the B input terminals of the adder 4 is progressively increased from "0" to a predetermined value. For the following sustain state, the data supplied to the B input terminals B of the adder 4 is held at the aforementioned predetermined value. By so doing, the level is held constant. Thereafter, upon detection of the key-off of the note key, the data supplied to the B input terminals of the adder 4 may be gradually increased from the aforementioned predetermined value to "32". When the data supplied to the B input terminals of the adder 4 becomes "32", the output level becomes zero, and the musical sound is terminated.

While in the above embodiment a sine wave is stored for $2^6$ (=64) sampling points, where a sine wave is stored for $2^n$ sampling points, the first and second waveforms read out from the sine wave ROM 7 are given as $$\sin 2\pi \frac{a}{2^n} \tag{52}$$

and

-continued $$\sin 2\pi \frac{a+b}{2^n} \tag{53}$$

and the resultant waveform is given as $$2\sin\frac{\pi}{2^{n-1}}\left(a+\frac{b}{2}\right)\cos\frac{\pi}{2^{n-1}}\cdot\frac{b}{2} \tag{54}$$

Further, while in the above embodiment the two sine waves are added together to obtain the resultant waveform, it is also possible to subtract two waves one from the other. In this case, the resultant waveform is $$\pm\left(\sin 2\pi\frac{a}{2^n}-\sin 2\pi\frac{a+b}{2^n}\right)= \mp 2\cos\frac{\pi}{2^{n-1}}\left(a+\frac{b}{2}\right)\sin\frac{\pi}{2^{n-1}}\frac{b}{2} \tag{55}$$

Thus, the envelope control value in this case is $$\mp 2\sin\frac{\pi}{2^{n-1}}\cdot\frac{b}{2} \tag{56}$$

Similarly, two cosine waves may be added or subtracted to obtain the resultant waveform. The calculations in these cases are $$\cos 2\pi\frac{a}{2^n}+\cos 2\pi\frac{a+b}{2^n}= 2\cos\frac{\pi}{2^{n-1}}\left(a+\frac{b}{2}\right)\cos\frac{\pi}{2^{n-1}}\frac{b}{2} \tag{57}$$

and $$\pm\left(\cos 2\pi\frac{a}{2^n}-\cos 2\pi\frac{a+b}{2^n}\right)= \pm 2\sin\frac{\pi}{2^{n-1}}\left(a+\frac{b}{2}\right)\sin\frac{\pi}{2^{n-1}}\frac{b}{2} \tag{58}$$

In the case of the equation (57), the envelope control value is $$2\cos\frac{\pi}{2^{n-1}}\frac{b}{2} \tag{59}$$

and in the case of the equation (58) the envelope control value is $$\pm 2\sin\frac{\pi}{2^{n-1}}\frac{b}{2} \tag{60}$$

What is claimed is:

1. In an electronic musical instrument in which periodic sinusoidal wave function data such as sine wave or cosine wave data is read out from a waveform memory according to a note frequency for forming a musical sound signal, an envelope control system for the electronic musical instrument comprising:

a source of envelope data, reading means coupled to said source of envelope data for reading out said periodic sinusoidal wave function data as two waveforms from at least one waveform memory, said two waveforms having the same frequency as each other and having different phases from each other, and for changing the amount of the phase difference between the two waveforms according to said envelope data, and synthesizing means coupled to said reading means for combining said two waveforms read out by said reading means, wherein envelope control of said periodic sinusoidal wave function is effected according to changes in said phases of said two waveforms in accordance with the envelope data.

2. The envelope control system according to claim 1, wherein said reading means reads out said two waveforms at said same frequency and having said different phases on a time division basis from said at least one waveform memory, in which said periodic sinusoidal wave data is stored, and supplies the read-out waveform data to said synthesizing means.

3. The envelope control system according to claim 1 or 2, wherein said reading means reads out $\sin 2\pi(a/2^n)$, $2^n$ being the total number of sampling points and "a" being the order number of the sampling point of reading, as the first waveform; and $$\sin 2\pi\left(\frac{a+b}{2^n}\right),$$

b being data representing phase difference, as the second waveform from said waveform memory; and said synthesizing means provides $$2\sin\frac{\pi}{2^{n-1}}\left(a+\frac{b}{2}\right)\cos\frac{\pi}{2^{n-1}}\cdot\frac{b}{2}$$

as the resultant output.

4. The envelope control system according to claim 1 or 2, wherein said reading means reads out $\sin 2\pi(a/2^n)$, $2^n$ being the total number of sampling points and "a" being the order number of the sampling point of reading, as the first waveform; and $$\sin 2\pi\left(\frac{a+b}{2^n}\right),$$

b being data representing phase difference, as the second waveform from said waveform memory; and said synthesizing means provides $$-2\cos\frac{\pi}{2^{n-1}}\left(a+\frac{b}{2}\right)\sin\frac{\pi}{2^{n-1}}\cdot\frac{b}{2} \text{ or } 2\cos\frac{\pi}{2^{n-1}}\left(a+\frac{b}{2}\right)\sin\frac{\pi}{2^{n-1}}\cdot\frac{b}{2}$$

as the resultant output.

5. The envelope control system according to claim 1 or 2, wherein said reading means reads out $\cos 2\pi(a/2^n)$, $2^n$ being the total number of sampling points and "a" being the order number of the sampling point of reading, as the first waveform; and $$\cos 2\pi\left(\frac{a+b}{2^n}\right),$$

b being data representing phase difference, as the second waveform from said waveform memory; and said synthesizing means provides $$2\cos\frac{\pi}{2^{n-1}}\left(a+\frac{b}{2}\right)\cos\frac{\pi}{2^{n-1}}\cdot\frac{b}{2}$$

as the resultant output.

6. The envelope control system according to claim 1 or 2, wherein said reading means reads out cos $2\pi(a/2^n)$, $2^n$ being the total number of sampling points and "a" being the order number of the sampling point of reading, as the first waveform; and $$\cos 2\pi\left(\frac{a+b}{2^n}\right),$$

b being data representing phase difference, as the second waveform; and said synthesizing means provides $$2\sin\frac{\pi}{2^{n-1}}\left(a+\frac{b}{2}\right)\sin\frac{\pi}{2^{n-1}}\cdot\frac{b}{2}\text{ or}$$

$$-2\sin\frac{\pi}{2^{n-1}}\left(a+\frac{b}{2}\right)\sin\frac{\pi}{2^{n-1}}\cdot\frac{b}{2}$$

as the resultant output.

7. In an electronic musical instrument in which a sinusoidal wave data such as sine wave or cosine wave data representing a sinusoidal wave is read out from a waveform memory according to a note frequency for forming a musical sound signal, an envelope control system for the electronic musical instrument comprising:

a source of envelope data, reading means coupled to said source of envelope data and to said waveform memory for reading out said sinusoidal wave data as two waveforms having the same frequency as each other and being phase shifted relative to each other, and for changing the amount of the relative phase shift between said two waveforms according to said envelope data; and synthesizing means coupled to said reading means for combining said two waveforms read out by said reading means, wherein envelope control of said sinusoidal wave is effected according to the magnitude of said phase shift of said two waveforms.

8. The envelope control system according to claim 7, wherein said reading means reads out said two waveforms at said same frequency and phase shifted relative to each other on a time division basis from said waveform memory, in which said sinusoidal wave data is stored, and supplies the read-out waveform data to said synthesizing means.

9. The envelope control system according to any one of claims 1, 2, 7 or 8, wherein said reading means reads out $$\sin 2\pi\left(\frac{a+b}{2^n}\right),$$

$2^n$ being the total number of sampling points, "a" being the order number of sampling points of reading, and b being data representing the magnitude of phase shift, as the first waveform; and $$\sin 2\pi\left(\frac{a-b}{2^n}\right)\text{ or }\sin 2\pi\left(\frac{b-a}{2^n}\right)$$

as the second waveform; and said synthesizing means reads out $$2\sin\frac{\pi}{2^{n-1}}a\cos\frac{\pi}{2^{n-1}}b\text{ or }2\cos\frac{\pi}{2^{n-1}}a\sin\frac{\pi}{2^{n-1}}b$$

as the resultant output.

10. The envelope control system according to any one of claims 1, 2, 7 or 8, wherein said reading means reads out $$\sin 2\pi\left(\frac{a+b}{2^n}\right),$$

$2^n$ being the total number of sampling points, "a" being the order number of sampling point of reading, and b being data representing the magnitude of the phase shift, as the first waveform; and $$\sin 2\pi\left(\frac{a-b}{2^n}\right)\text{ or }\sin 2\pi\left(\frac{b-a}{2^n}\right)$$

as the second waveform from said waveform memory; and said synthesizing means produces $$2\cos\frac{\pi}{2^{n-1}}a\sin\frac{\pi}{2^{n-1}}b,\ -2\cos\frac{\pi}{2^{n-1}}a\sin\frac{\pi}{2^{n-1}}b,$$

$$2\sin\frac{\pi}{2^{n-1}}a\cos\frac{\pi}{2^{n-1}}b\text{ or }-2\sin\frac{\pi}{2^{n-1}}a\cos\frac{\pi}{2^{n-1}}b$$

as the resultant output.

11. The envelope control system according to any one of claims 1, 2, 7 or 8, wherein said reading means reads out $$\cos 2\pi\left(\frac{a+b}{2^n}\right),$$

$2^n$ being the total number of sampling points, "a" being the order number of sampling point of reading, and b representing the magnitude of phase difference, as the first waveform; and $$\cos 2\pi\left(\frac{a-b}{2^n}\right)$$

as the second waveform from said waveform memory; and said synthesizing means produces $$2\cos\frac{\pi}{2^{n-1}}a\cos\frac{\pi}{2^{n-1}}b$$

as the resultant output.

12. The envelope control system according to any one of claims 1, 2, 7 or 8, wherein said reading means reads out $$\cos 2\pi\left(\frac{a+b}{2^n}\right),$$

$2^n$ being the total number of sampling points, "a" being the order number of sampling point of reading, and b being data representing the magnitude of phase difference, as the first waveform; and $$\cos 2\pi\left(\frac{a-b}{2^n}\right)$$

as the second waveform from said waveform memory; and said synthesizing means produces either $$-2\sin\frac{a-b}{2^{n-1}}a\sin\frac{\pi}{2^{n-1}}b \text{ or } 2\sin\frac{\pi}{2^{n-1}}a\sin\frac{\pi}{2^{n-1}}b$$

as the resultant output.

13. In an electronic musical instrument of the type including a source of envelope data, means for reading out from a waveform memory two sinusoidal waves, said two sinusoidal waves comprising two sine waves having the same frequency as each other and phase shifted relative to each other, or two cosine waves having the same frequency as each other and phase shifted relative to each other, and for changing the amount of the relative phase shift of said two sine waves or said two cosine waves according to said envelope data, sinusoidal wave data being stored in said waveform memory; and means for combining the two read-out sinusoidal waveforms to obtain a resultant sinusoidal wave signal and for effecting envelope control of said resultant sinusoidal wave signal by changing the amount of said phase shift, an envelope control system for the electronic musical instrument comprising:

control means for making a rate of change of the amount of the relative phase shift between said two sinusoidal waves non-uniform such that exponentially attenuating envelope control is effected under the control of said control means.

14. The envelope control system according to claim 13, wherein said control means includes means for approximating a function waveform with a plurality of straight line segments, so as to make said rate of change of the phase shift non-uniform to obtain exponential curves for the approximation straight line segments and to change the rate of change of the amount of the phase shift for each of said approximation straight line segments.

15. The envelope control system according to claim 13 or 14, wherein said electronic musical instrument is further provided with means for correcting said non-uniform rate of change of the amount of the phase shift provided by said control means to a substantially constant rate for the attack portion of the envelope of said resultant sinusoidal wave signal.

16. An electronic musical instrument comprising:

frequency data generating means for generating frequency data corresponding to a given note for each of a plurality of time division basis channels;

fundamental sound address specifying means coupled to said frequency data generating means for specifying the phase address for fundamental sound according to frequency data provided for each channel from said frequency data generating means;

harmonic sound address specifying means coupled to said fundamental sound address specifying means for specifying the phase address of a harmonic of a given order on a time division basis in each channel according to the phase address for the fundamental sound specified by said fundamental sound address specifying means;

a waveform memory for storing a sinusoidal wave such as a sine wave or cosine wave;

envelope data generating means for generating envelope data corresponding to the fundamental sound and harmonic sounds in each of said channels; and reading means for reading out two sinusoidal waves at a same frequency as each other and phase shifted relative to each other according to said envelope data on a time division basis from said waveform memory for the fundamental sound and harmonic sounds in each of said channels according to the phase address data of said fundamental sound address specifying means and harmonic sound address specifying means; and synthesizing means coupled to said reading means for combining said two waveforms read out by said reading means.

* * * * *